US006230065B1

(12) United States Patent
Tsujita

(10) Patent No.: US 6,230,065 B1
(45) Date of Patent: May 8, 2001

(54) BOWLING SCORE DISPLAY APPARATUS

(75) Inventor: Masahiro Tsujita, Osaka (JP)

(73) Assignee: Telesystems Co., LTD, Osaka (JP)

( * ) Notice: Subject to any disclaimer, the term of this patent is extended or adjusted under 35 U.S.C. 154(b) by 0 days.

(21) Appl. No.: 09/097,610

(22) Filed: Jun. 15, 1998

(30) Foreign Application Priority Data

Jun. 17, 1997 (JP) ..... 9-159565

(51) Int. Cl.[7] ..... G06F 155/00; A63D 5/00

(52) U.S. Cl. ..... 700/92; 473/70; 473/71

(58) Field of Search ..... 463/4, 2, 30, 31, 463/32, 33, 34; 473/54, 70, 71, 67, 131, 407, 409; 340/323 B; 700/91, 92; 353/45; 345/473

(56) References Cited

U.S. PATENT DOCUMENTS 4,951,039 * 8/1990 Schwendeman et al. ..... 340/725
5,241,379 * 8/1993 Tsujita ..... 358/93

* cited by examiner

*Primary Examiner*—Valencia Martin-Wallace
*Assistant Examiner*—Julie Kasick
(74) *Attorney, Agent, or Firm*—Pillsbury Winthrop LLP

(57) ABSTRACT

In a screen where score display is presented, a numeric value or mark responsive to a state of pins after a bowl is preliminarily displayed, and then the preliminary display is transformed or moved so that the numeric value or mark is displayed in the square. This allows an easier understanding of the correspondence between changes in the contents of score display on the display screen and actual progress of a bowling game.

5 Claims, 21 Drawing Sheets

(A)

(B)

(C)

(A)

(B)

(C)

(A)

(B)

(C)

(A)

(B)

(C)

(A)

(B)

(C)

(A)

(B)

(C)

(A)

(B)

(C)

(A)

(B)

(C)

(A)

(B)

(A)

(B)

(C)

(A)

(B)

(C)

(A)

(B)

(C)

(A)

(B)

(C)

(A)

(B)

(C)

(A)

(B)

(A)

(B)

BOWLING SCORE DISPLAY APPARATUS

BACKGROUND OF THE INVENTION

The present invention relates to a bowling score display apparatus to be used for bowling games.

In conventional common bowling alleys, before lanes are provided consoles for detecting the pin state after a bowl and counting the bowling score.

In a bowling alley provided with such a bowling console, because the score is automatically displayed on a CRT or overhead CRT provided in the console, bowlers are not required to enter their own score or other bowlers' score in the score sheet. Therefore, bowlers are allowed to dedicate themselves to the bowling game so that the bowling game progresses smoothly as a whole.

Such automatic bowling scoring equipment has been practiced in many bowling alleys since earlier days, being quite general as equipment for bowling alleys.

However, in such a conventional bowling score display apparatus that processes and displays bowling score, display contents no more than when the score is entered in the score sheet one by one would be presented on the CRT or the like. Accordingly, after a bowl is performed by one bowler, only a numeric value or mark would be displayed in the relevant square in response to a result of pin-state detection, where the display contents in the whole screen would show almost no change. For this reason, in some cases, the gallery in particular could not read any change in the contents of score display without scrutinizing the score display presented on the CRT or the like, so that the gallery could not well understand the correspondence between the contents of score display in the display screen and the actual progress of the bowling game. Although such functions as presenting an applausive display upon occurrence of a strike, spare or other particular event are, of course, generally included, there would still be difficulties in understanding as to which numeric value or mark has been added in which square in the form of score sheet.

An object of the present invention is therefore to provide a bowling score display apparatus which makes it possible to easily understand the correspondence between a change in the contents of score display on the display screen and the progress of the actual bowling game.

SUMMARY OF THE INVENTION

In an embodiment of the present invention, there is provided a bowling score display apparatus comprising:

- a pin detection device for detecting a state of at least one pin in a pin set position after a bowl;
- a counter for counting a bowling score from the state of the at lest one pin after the bowl;
- a score display for displaying the bowling score,
- said score display preliminarily displaying a first graphic image responsive to the state of the pins after the bowl, and
- said score display, after preliminarily displaying said graphic image, transforming the graphic image into a displayed element of the displayed bowling score.

With this constitution, a numeric value (e.g., the number of fallen pins or the point at the relevant frame), mark (e.g., a mark of strike, spare, gutter or the like) or other graphic image (e.g., an image such as an animation of applauding a strike or spare) responsive to the state of the pins after a bowl is once preliminarily displayed, and then the preliminary display is transformed or moved so that the numeric value or mark is displayed in the square of the score. As a result, it looks like a numeric value or mark is preliminarily displayed in a region other than the square where the display should be presented and then the display contents are transformed or moved so as to be finally accommodated in the square of the score where the display should be presented. Therefore, it can be easily understood which bowl in which frame and by which bowler the current bowl falls upon.

The numeric value of preliminary display corresponds to the number of fallen pins, and is displayed with a numeral larger in size than the numeric value to be displayed in the square. This makes the number of fallen pins obvious at a glance.

The mark responsive to the state of the pins is a mark which indicates an event such as a strike or a spare and which is displayed in a size larger than that of the mark for score display displayed in the square. This makes it obvious at a glance that an event such as a strike, spare or gutter has occurred.

The score display means displays tracks of display within the display screen during the process of transforming or moving the preliminarily displayed graphic image. This makes it easily understandable that the contents of the preliminary display have entered into a specified square of score display.

Further, in another embodiment of the present invention, there is provided a bowling score display apparatus comprising:

- a pin detection device for detecting a state of at least one pin in a pin set position after a bowl;
- a counter for counting a bowling score from the state of the at least one pin after the bowl;
- a score display for displaying the bowling scores of a plurality of bowlers, one of said bowlers being the current bowler, and
- said score display displaying the bowling score of the current bowler in a size larger than bowling scores of the other bowlers. With this constitution, it can be easily understood which frame by which bowler the current bowl falls upon.

DETAILED DESCRIPTION OF THE PREFERRED EMBODIMENTS

Figure 1:
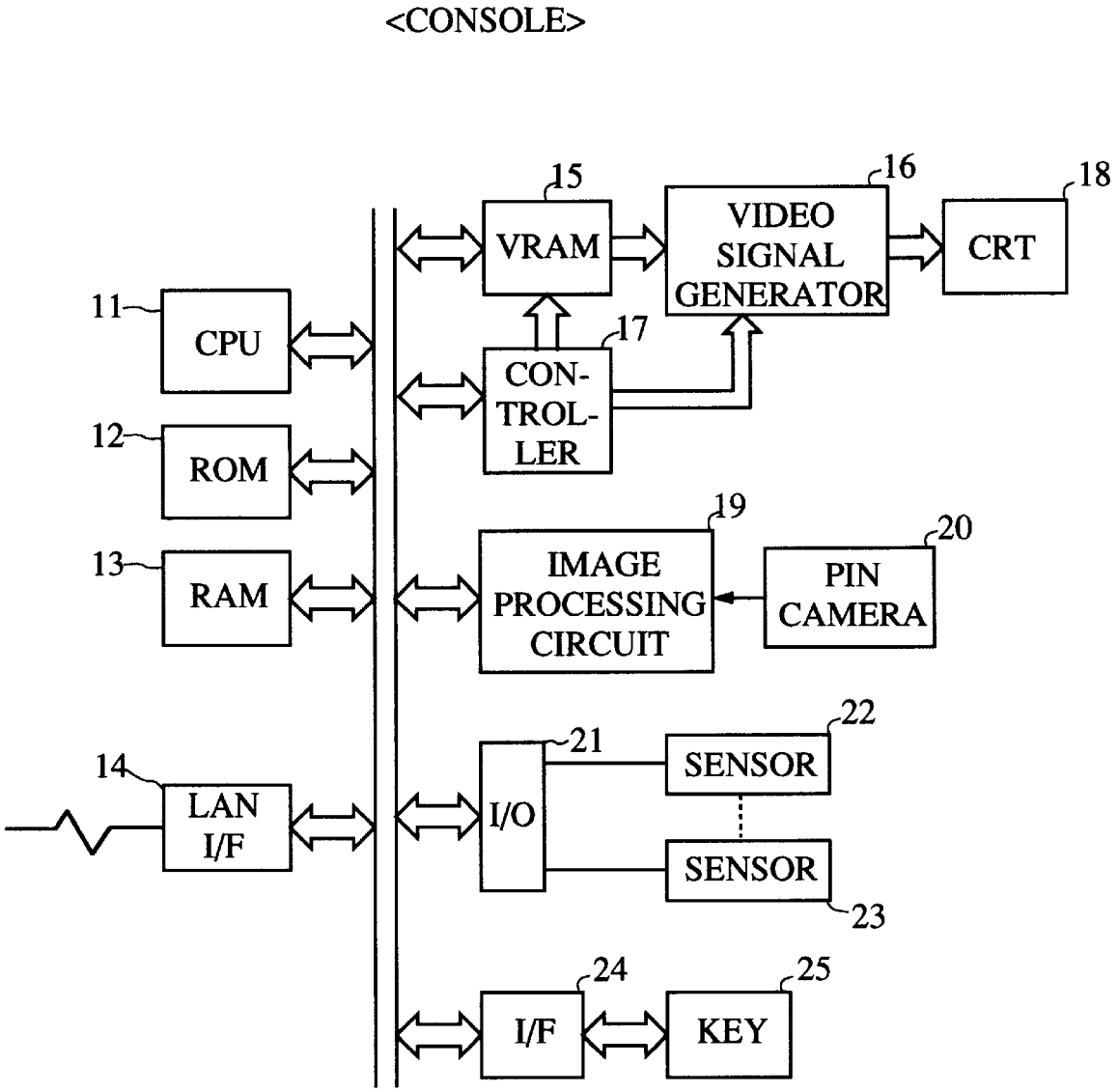
FIG. 1 is a block diagram showing the configuration of a bowling score display apparatus according to a first embodiment of the present invention.

FIG. 1 shows a block diagram of the constitution of a bowling score display apparatus which is an embodiment of the present invention.

Referring to the figure, a CPU 11, a ROM 12, a RAM 13 and a LAN interface 14 are shared by two lanes. The other blocks are actually provided individually for two lanes, but only those for one lane are shown in the figure. The CPU 11 executes programs previously programmed in the ROM 12 and programs loaded to the RAM 13 to perform later-described score processing, display control for a CRT 18 and the like. The RAM 13 is used as a working area in the execution of the programs. The LAN interface 14 performs data transfer control with a front manager, which is a host computer provided at the front desk, via a local area network. A VRAM 15 is a display memory, and a controller 17 performs addressing for the contents of the VRAM 15 sequentially according to raster scans of the CRT 18. A video signal generator 16 generates a display signal for the CRT 18 based on display data outputted from the VRAM 15 and a timing signal derived from the controller 17. The CPU 11 writes to the VRAM 15 data that depends on the contents to be displayed, so that score display and the like can be done on the CRT 18. An image processing circuit 19 inputs an image signal picked up by a pin camera 20, and performs specified image processing with the signal to generate binary-coded image data that facilitates the detection of standing pins and fallen pins. The CPU 11 reads the resulting binary-coded image data to detect the standing/fallen state of pins. Sensors 22, . . . , 23 are a bowl passage sensor, a foul sensor or other sensors, where the CPU 11 reads detection states of these sensors via an I/O port 21 to detect a bowl and the like. A keyboard 25 is used to perform key operations such as the correction of score, the correction of bowlers' names, designation for game reckoning, and the like, where the CPU 11 reads the contents of a key operation via an interface 24.

Next, examples of various kinds of score display are described with reference to FIGS. 2 through 14.

Figure 2:
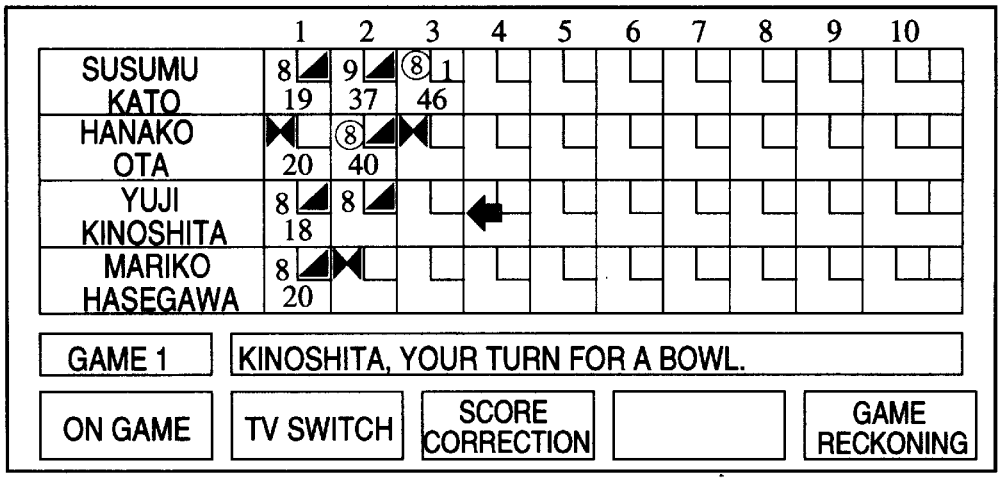
FIGS. 2A, 2B, 2C are views showing a first score display example.
Figure 2:
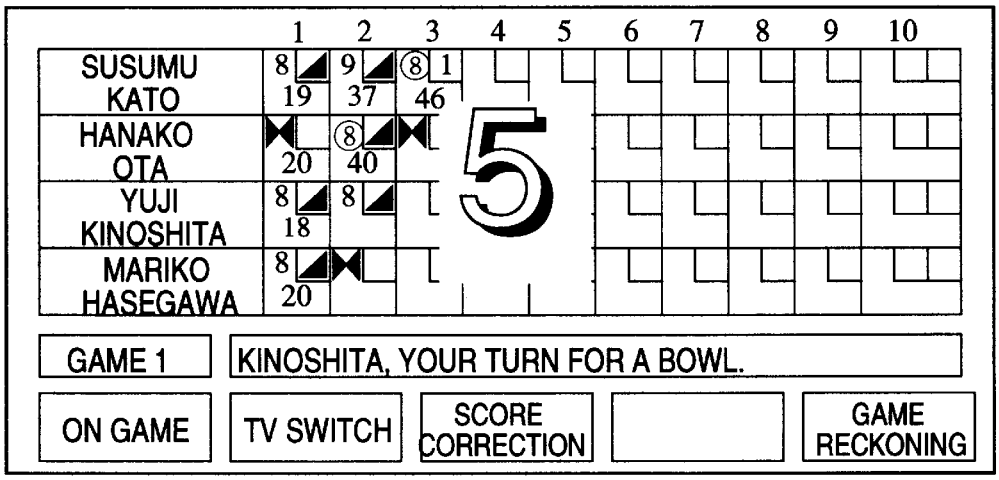
Figure 2:
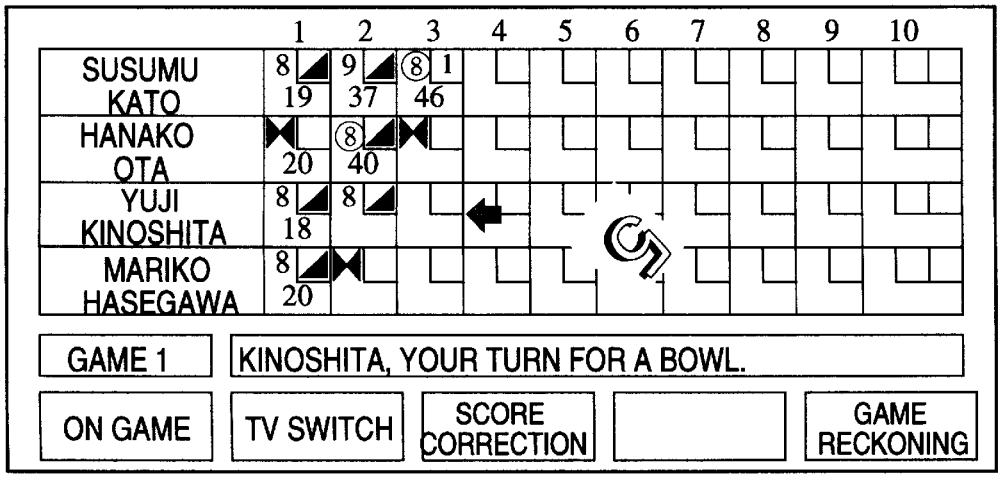
Figure 3:
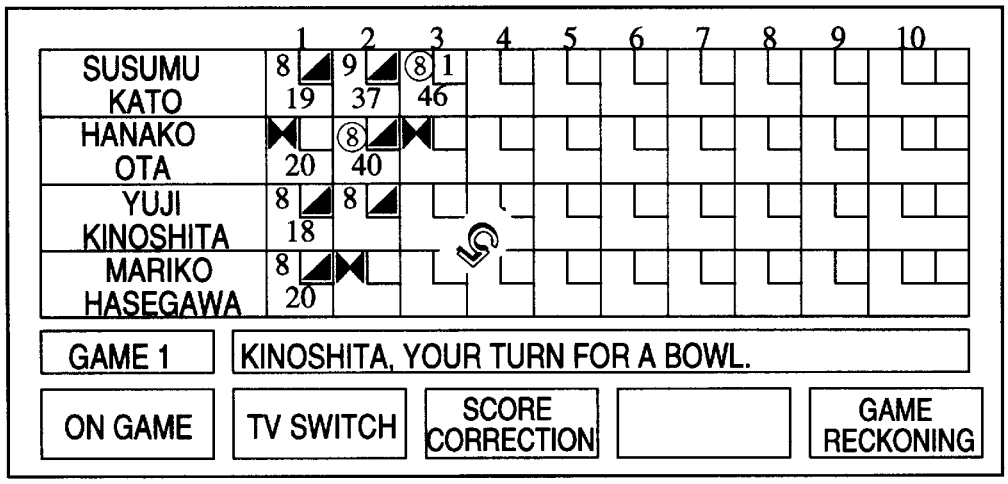
FIGS. 3A, 3B, 3C are views showing the first score display example.
Figure 3:
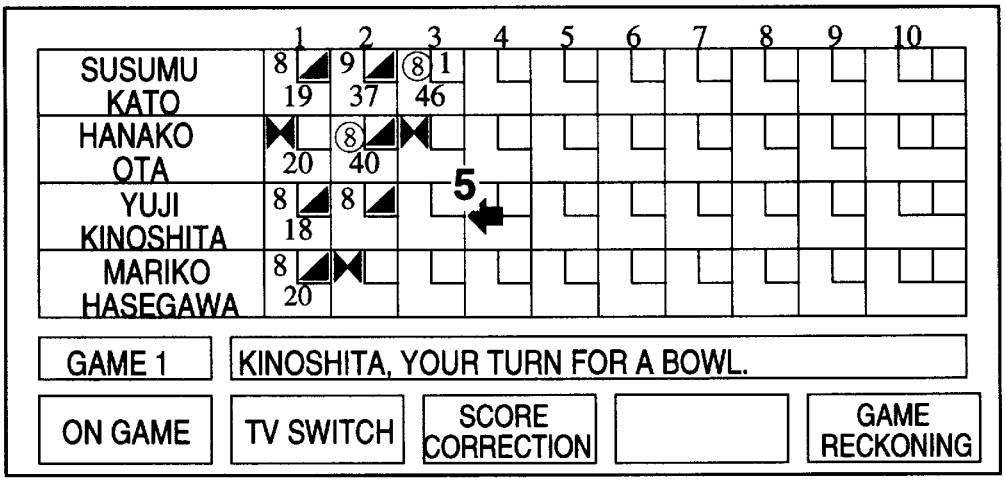
Figure 3:
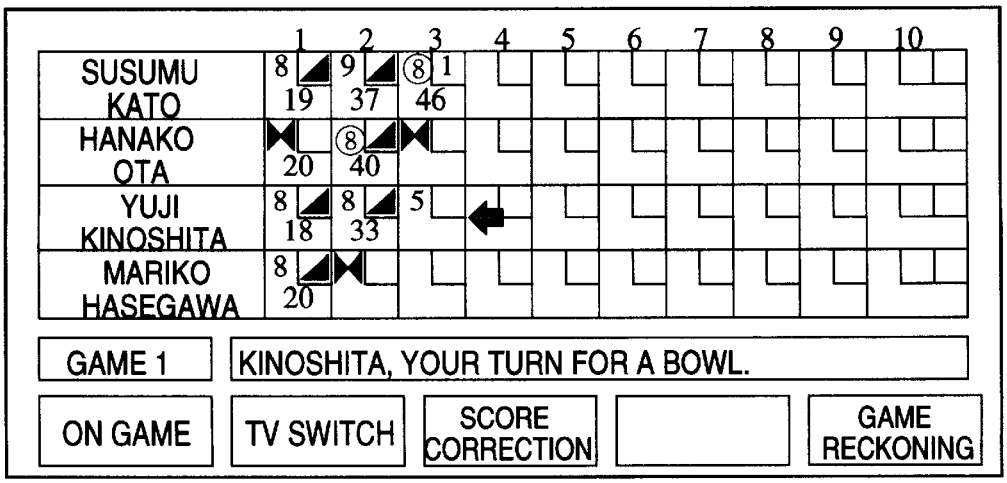

FIGS. 2 and 3 show a first display example. Referring to FIG. 2A, the arrow mark indicates the bowler who is now going to bowl and the relevant frame position. In a bowl-waiting state, a guidance display indicating a bowler's name and the bowler's being to bowl is presented as shown in the figure. It is noted that four items of display, "TV SWITCH", "SCORE CORRECTION", " ", "GAME RECKONING", are display items representing the functions of function keys arrayed in the fore (CRT side) of the keyboard.

In this state, if the bowler (Kinoshita) has bowled with a result of five fallen pins, a numeric value corresponding to the number of fallen pins is first displayed with a numeral larger than those in the squares of score display as shown in FIG. 2B. Subsequently, as shown in FIGS. 2C→FIG. 3A→FIG. 3B, the preliminary-display numeric value "5" is scaled down stepwise while being rotated and moved, so as to approach the inside of a square of score display where the final display should be made. After that, as shown in FIG. 3C, the numeric value "5" is displayed in the specified square.

Figure 4:
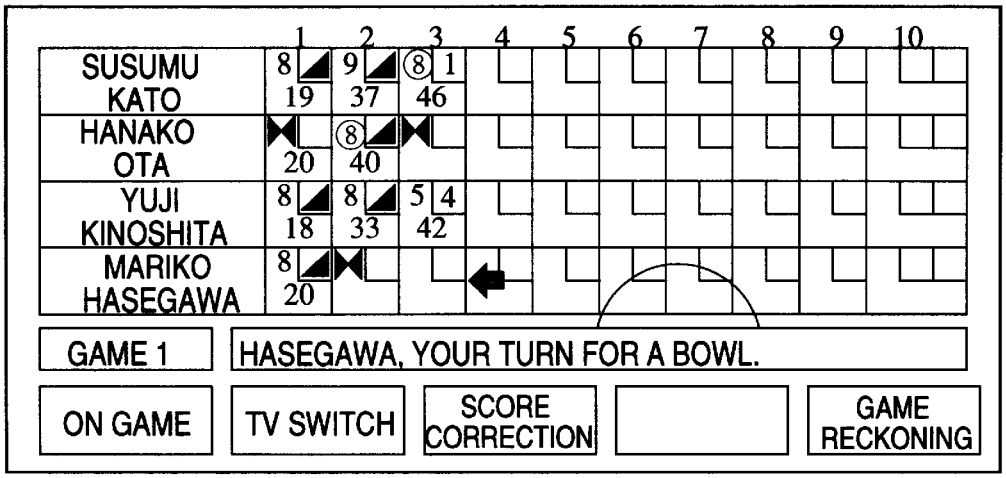
FIGS. 4A, 4B, 4C are views showing a second score display example.
Figure 4:
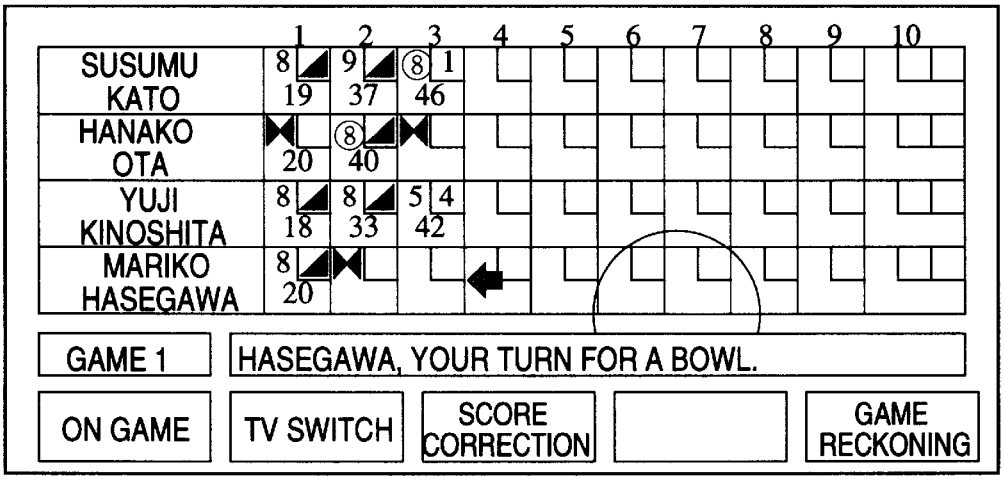
Figure 4:
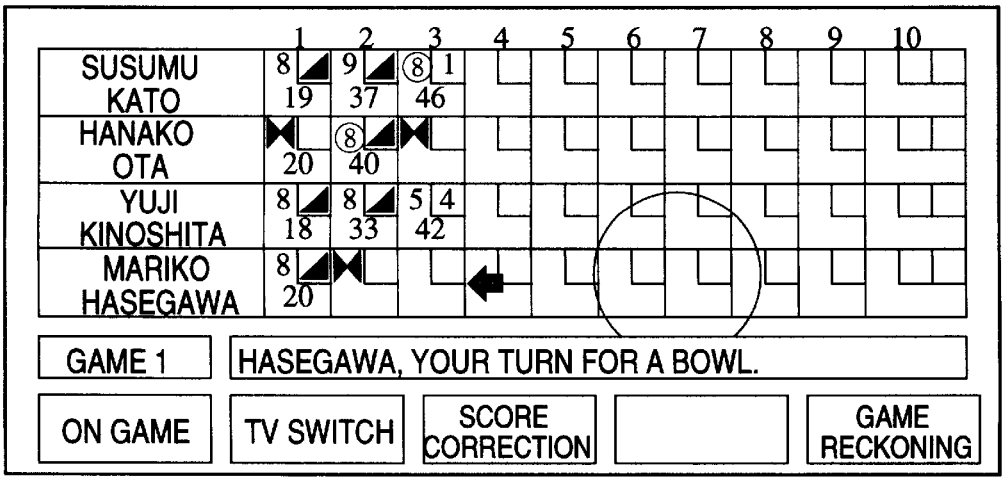
Figure 5:
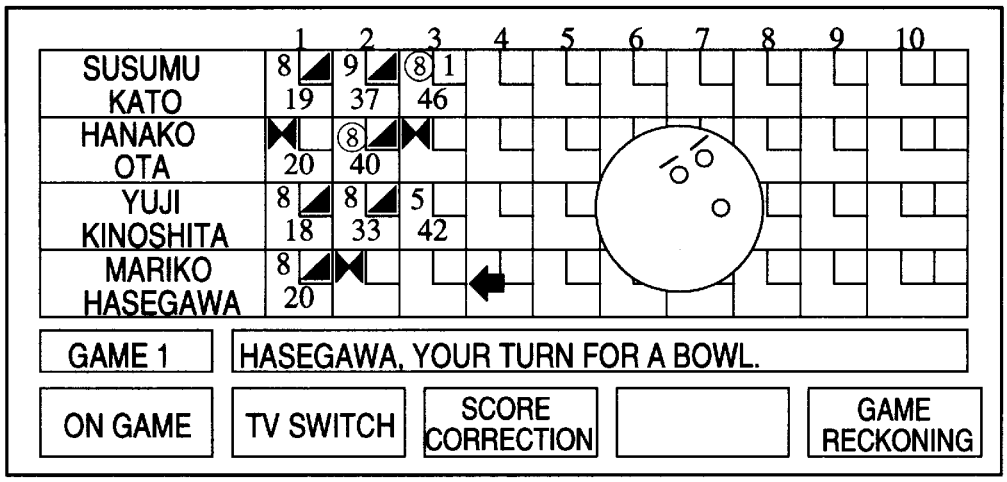
FIGS. 5A, 5B, 5C are views showing the second score display example.
Figure 5:
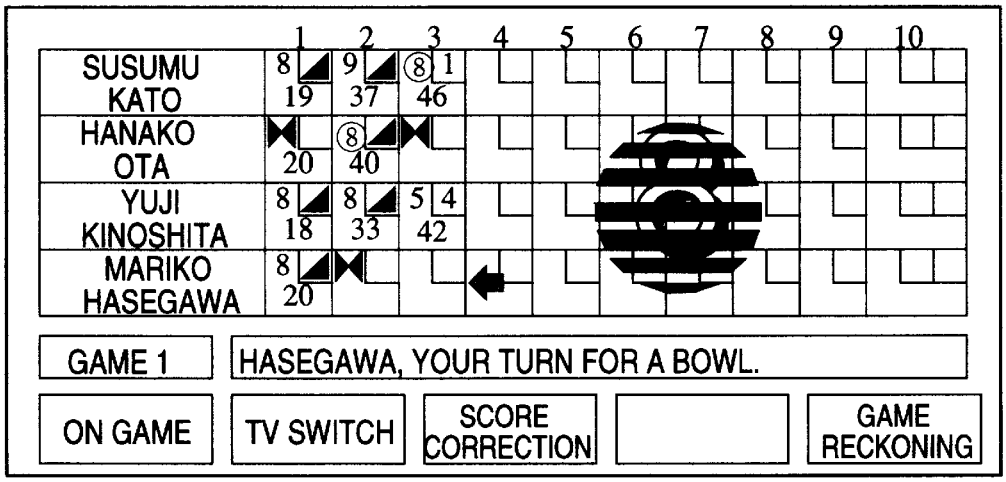
Figure 5:
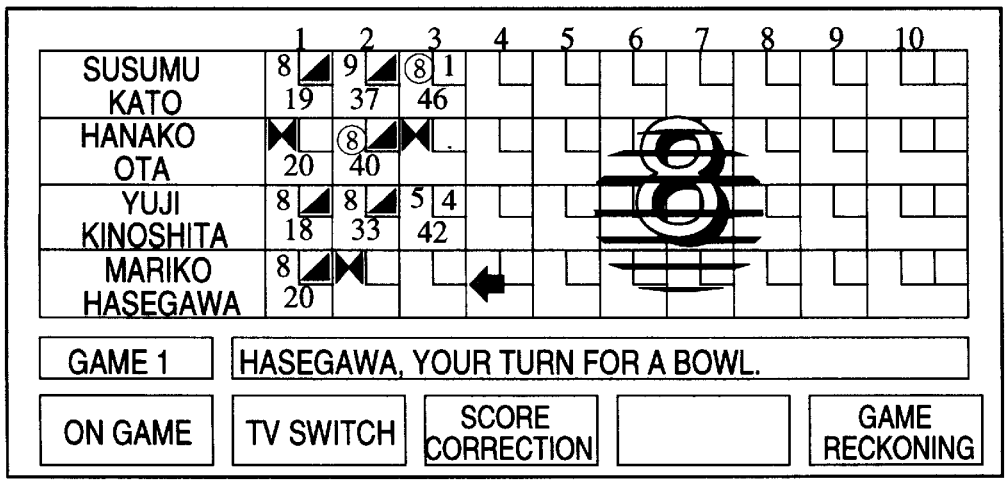
Figure 6:
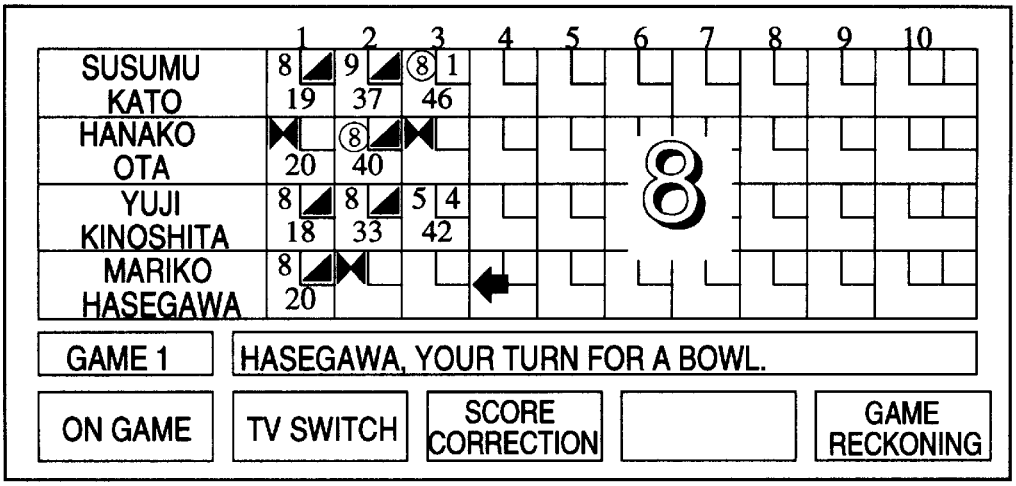
FIGS. 6A, 6B, 6C are views showing the second score display example.
Figure 6:
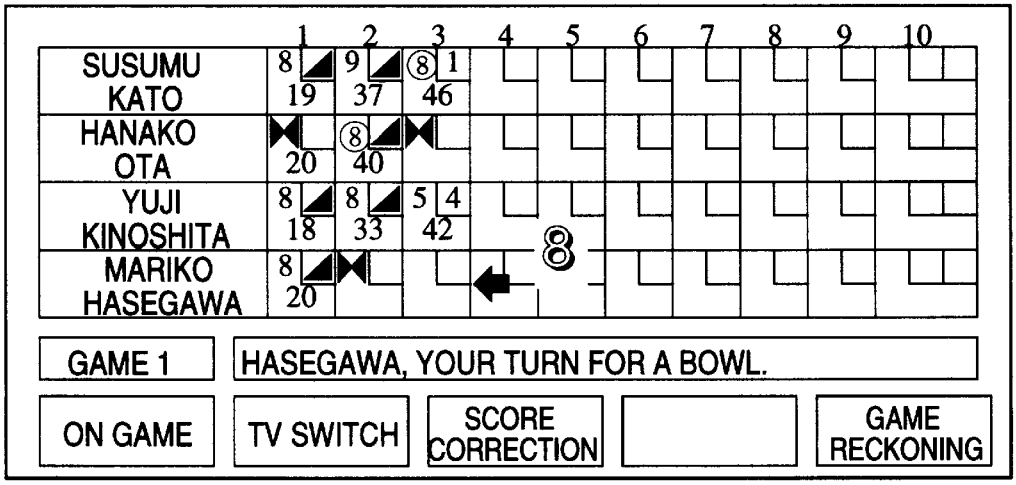
Figure 6:
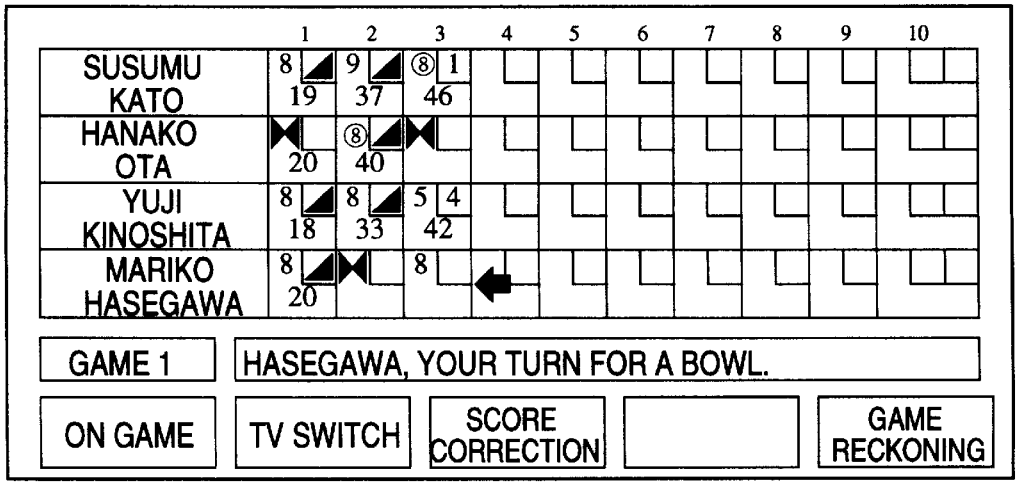

FIGS. 4 to 6 are views showing a second display example. After a bowl, an image is displayed and moved within the screen of score display like a bowl rolls, as shown in FIG. 4A→FIG. 4B→FIG. 4C, and subsequently the image is gradually changed to a numeric value corresponding to the current bowling result as shown in FIG. 5A→FIG. 5B→FIG. 5C. In this case, an example of eight fallen pins is shown. After that, the numeric value is gradually scaled down as shown in FIG. 6A→FIG. 6B→FIG. 6C, so that the numeric value is finally displayed in the relevant square.

Figure 7:
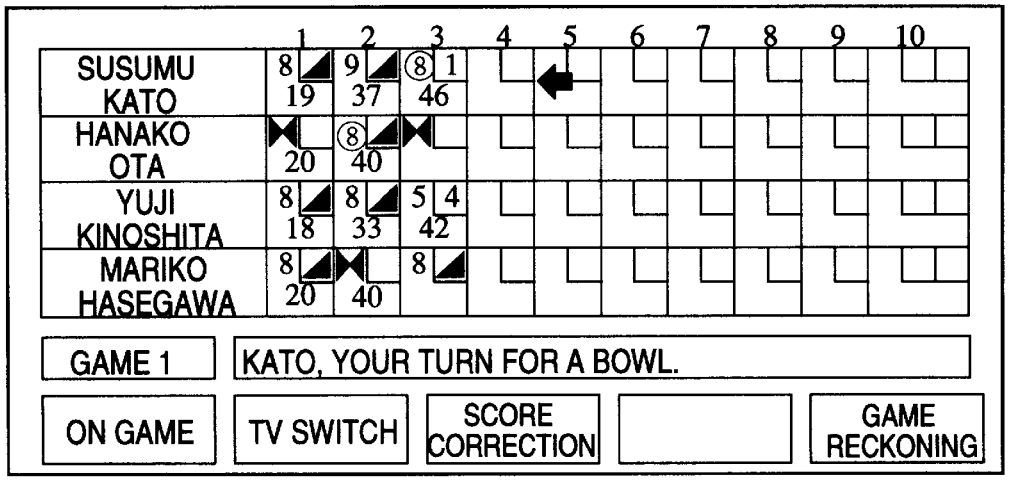
FIGS. 7A, 7B, 7C are views showing a third score display example.
Figure 7:
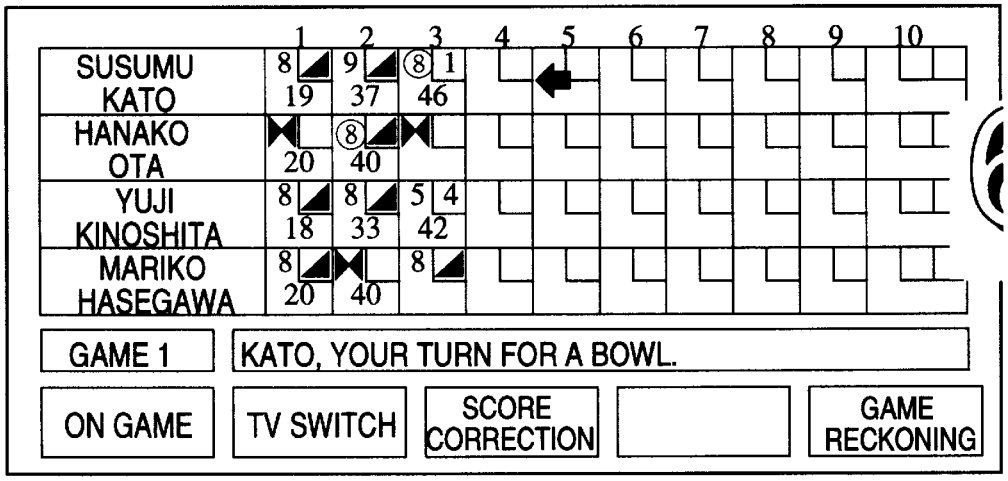
Figure 7:
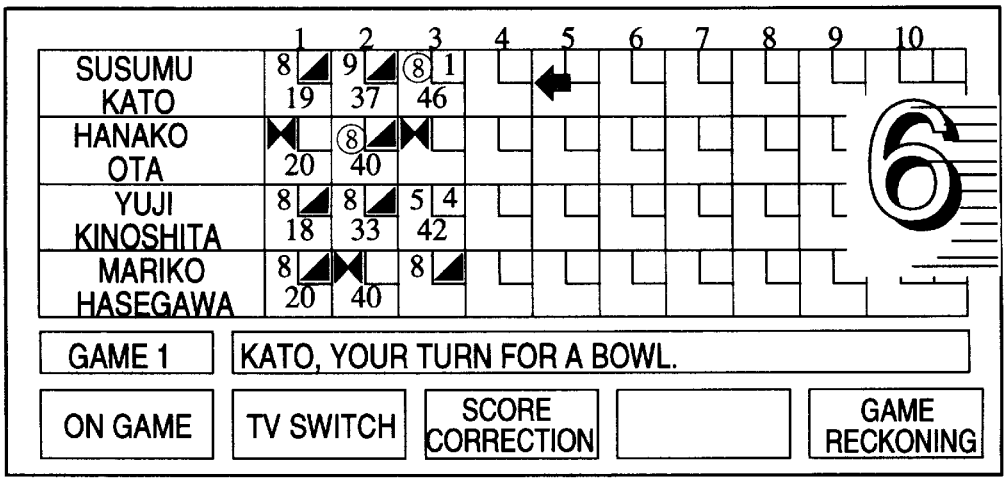
Figure 8:
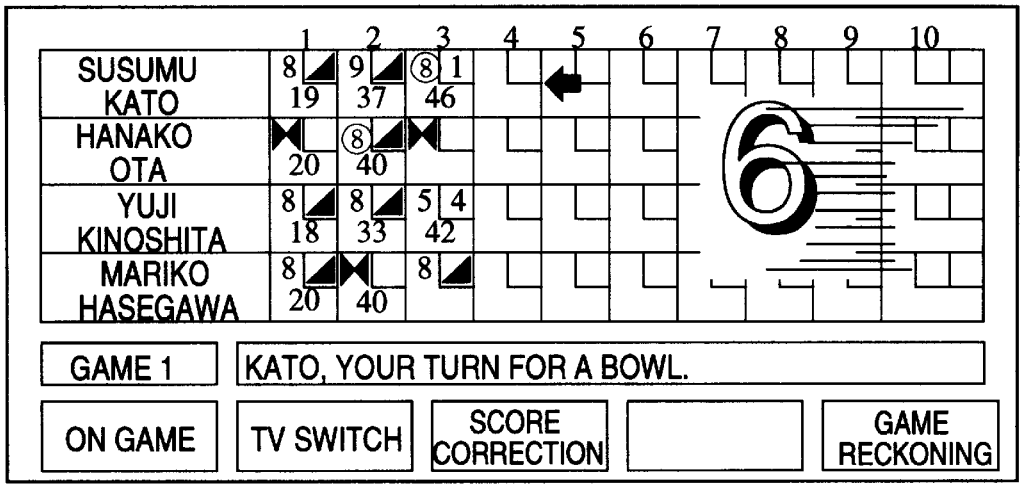
FIGS. 8A, 8B, 8C are views showing the third score display example.
Figure 8:
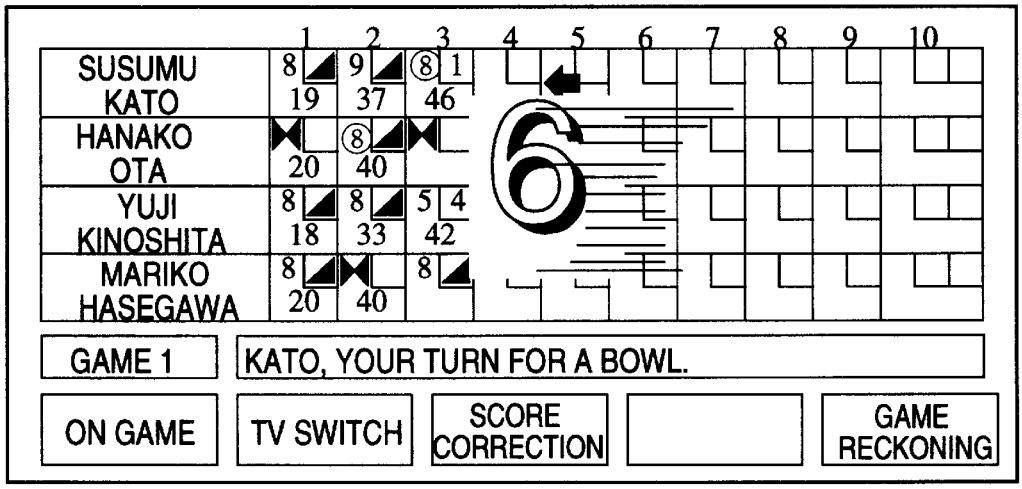
Figure 8:
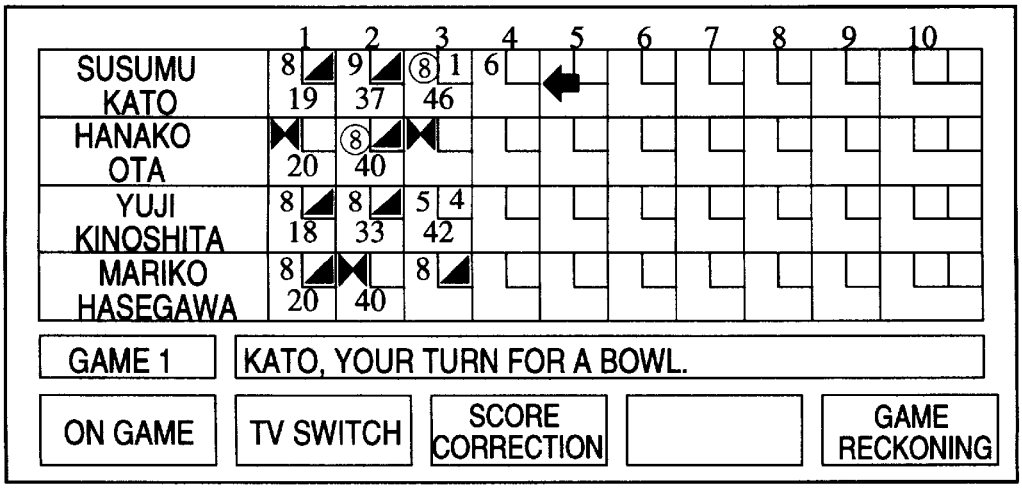

FIGS. 7 and 8 are views showing a third display example. First, as shown in FIG. 7A→FIG. 7B→FIG. 7C→FIG. 8A→FIG. 8B, a numeric value corresponding to a bowling result is displayed and moved so as to enter from outside to inside of score display, while tracks of the movement are displayed simultaneously. In this case, an example of six fallen pins is shown. After that, the preliminary display is erased and the numeric value is displayed in the relevant square as shown in FIG. 8C.

Figure 9:
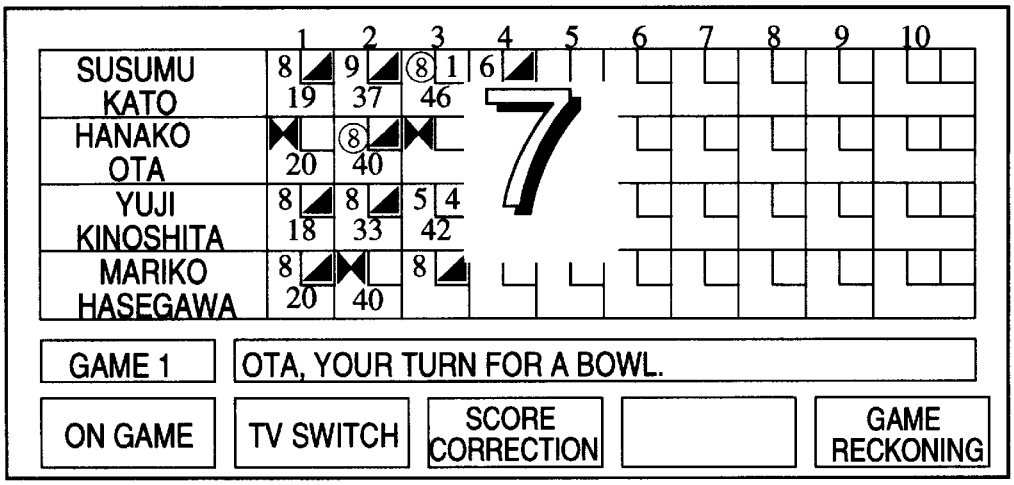
FIGS. 9A, 9B, 9C are views showing a fourth score display example.
Figure 9:
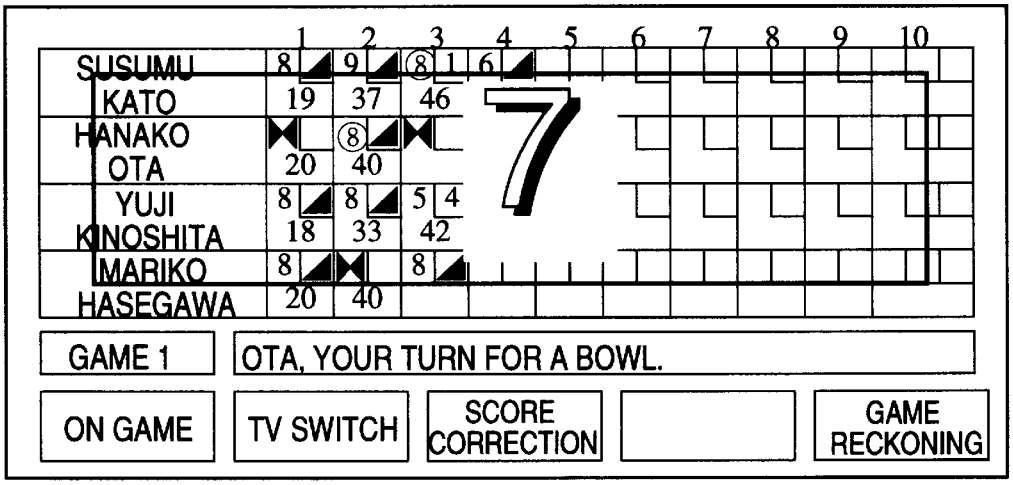
Figure 9:
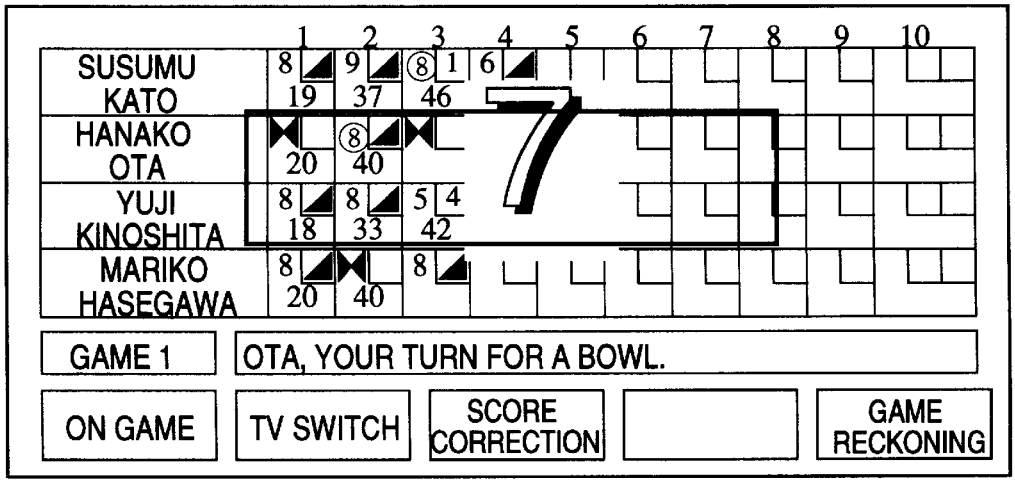
Figure 10:
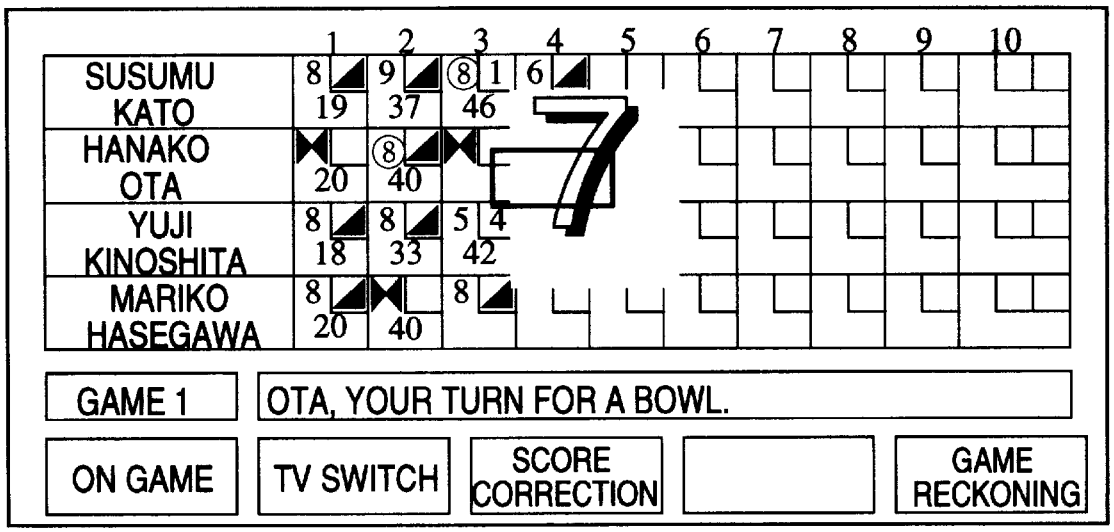
FIGS. 10A, 10B are views showing the fourth score display example.
Figure 10:
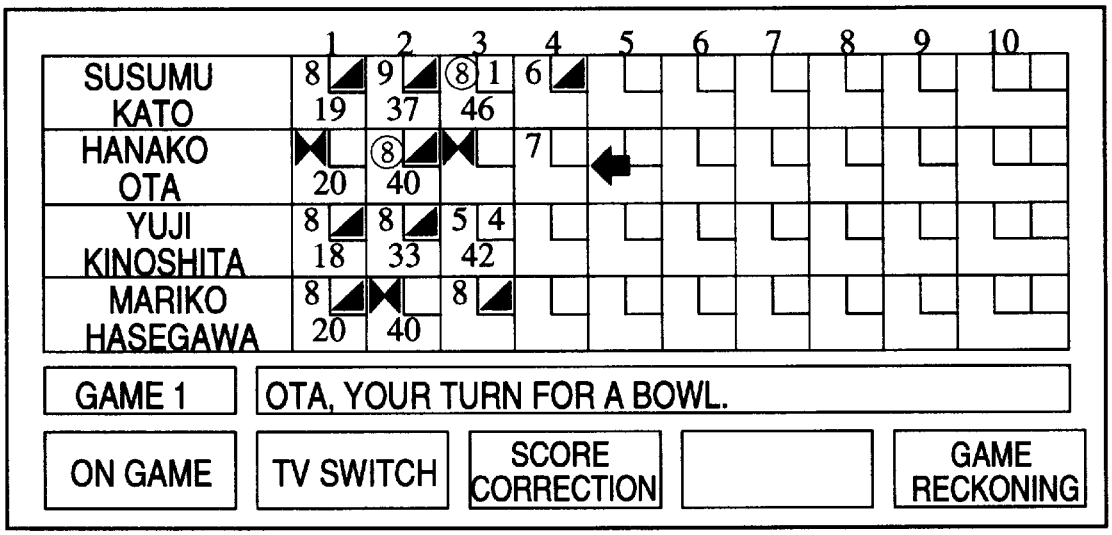

FIGS. 9 and 10 are views showing a fourth display example. For example, if seven pins have been fallen down by the current bowl, the numeric value is displayed in nearly the center of score display as shown in FIG. 9A while a framed auxiliary display is displayed and gradually scaled down as shown in FIG. 9B→FIG. 9C→FIG. 10A. Finally, the numeric value is displayed in the specified square as shown in FIG. 10B. Like this, even though the preliminary display of "7" is constant in size, gradually scaling down the framed auxiliary display makes it possible to impress that the preliminary display of "7" has entered into the relevant square. In this case, the destination of scaling down the framed auxiliary display is not necessarily required to be the relevant square, and instead a constant scaled-down display may be done at all times. Also, the framed auxiliary display is not necessarily required to be a transparent frame, and instead the inside of the frame may be displayed in an opaque color or transparent color.

Figure 11:
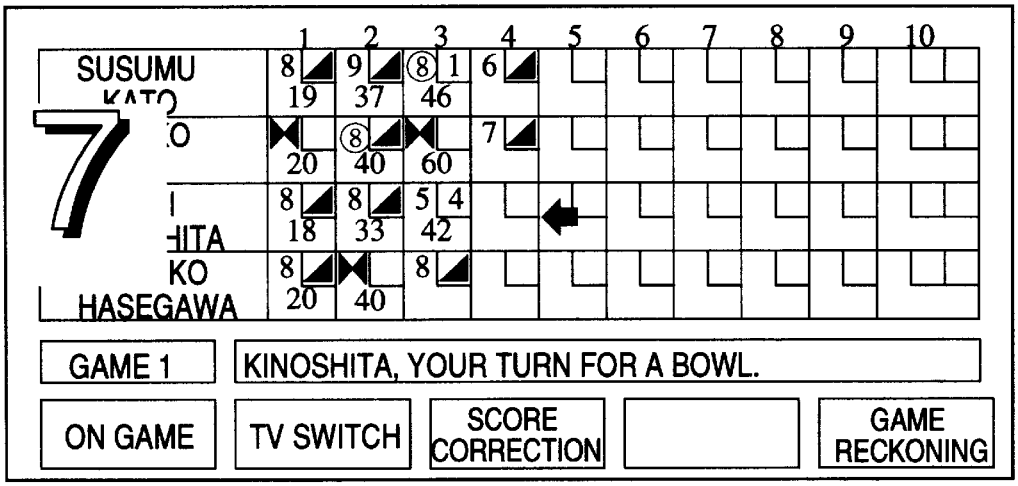
FIGS. 11A, 11B, 11C are views showing a fifth score display example.
Figure 11:
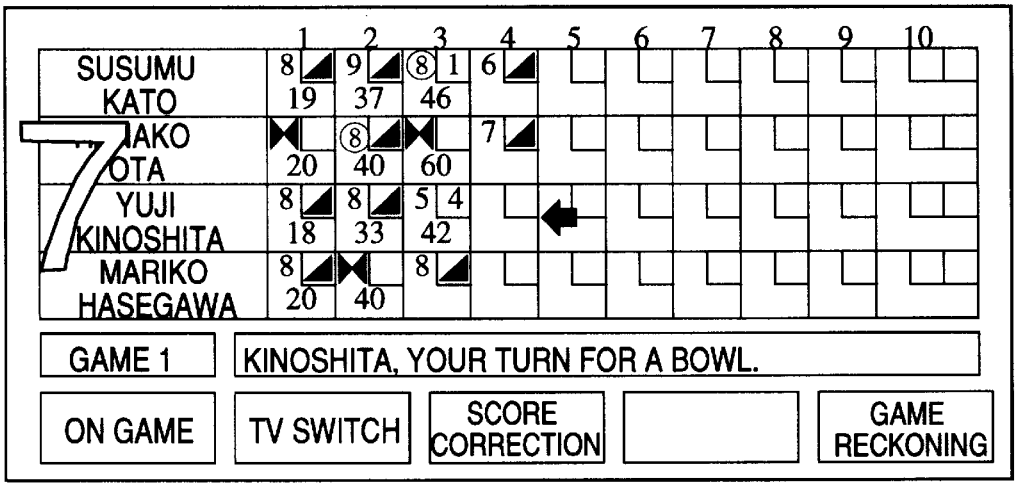
Figure 11:
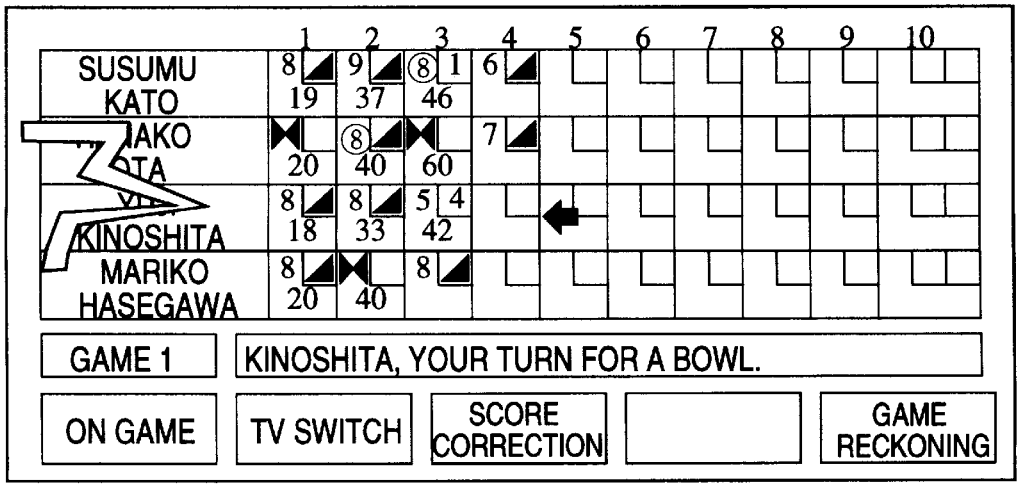
Figure 12:
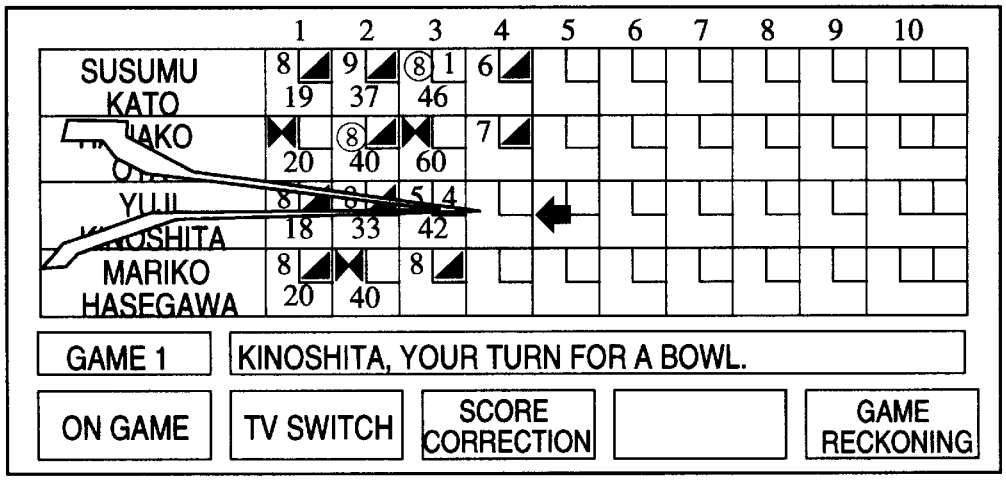
FIGS. 12A, 12B, 12C are views showing the fifth score display example.
Figure 12:
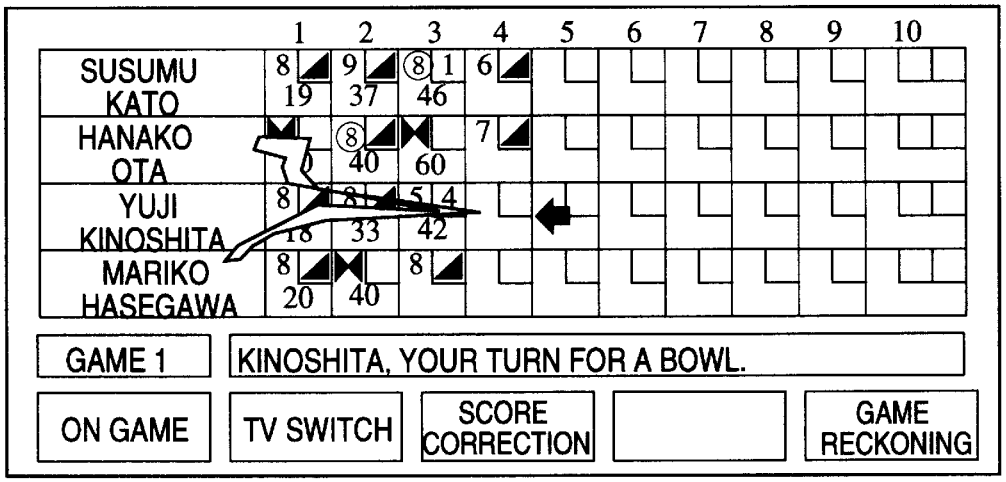
Figure 12:
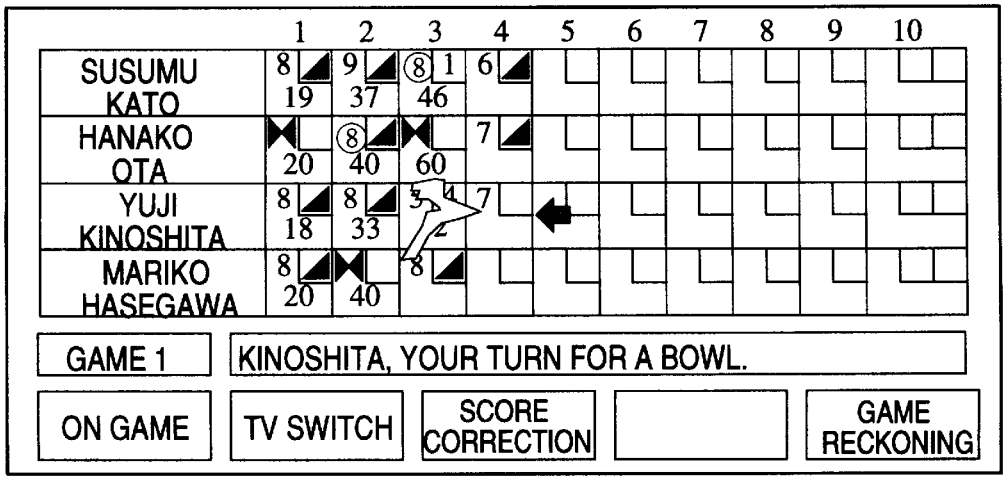

FIGS. 11 and 12 are views showing a fifth display example. First, as shown in FIG. 11A, a preliminary display "7" is presented at a location away from the square where the final display should be presented. The numeral is then transformed and moved as shown in FIG. 11B→FIG. 11C→FIG. 12A→FIG. 12B→FIG. 12C, where the numeral is displayed so as to be absorbed into the square where it should be finally displayed. After the display as shown in FIG. 12C, the preliminary display is erased and the updated score is displayed.

The above examples have been shown on cases in which the numeric value corresponding to the number of pins fallen down by a bowl is preliminarily displayed. When a strike or a spare, for example, has occurred, a strike mark or a spare mark would be preliminarily displayed and then transformed and moved likewise.

Figure 13:
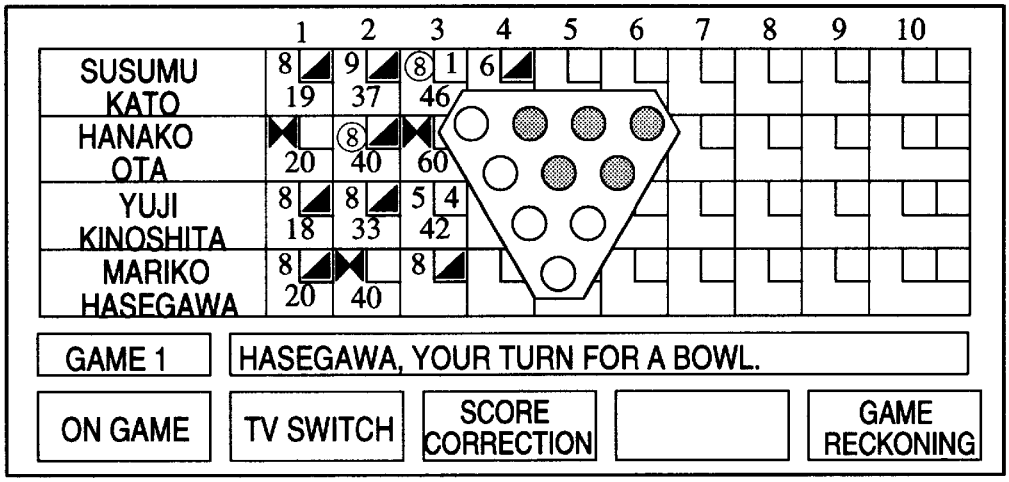
FIGS. 13A, 13B, 13C are views showing a sixth score display example.
Figure 13:
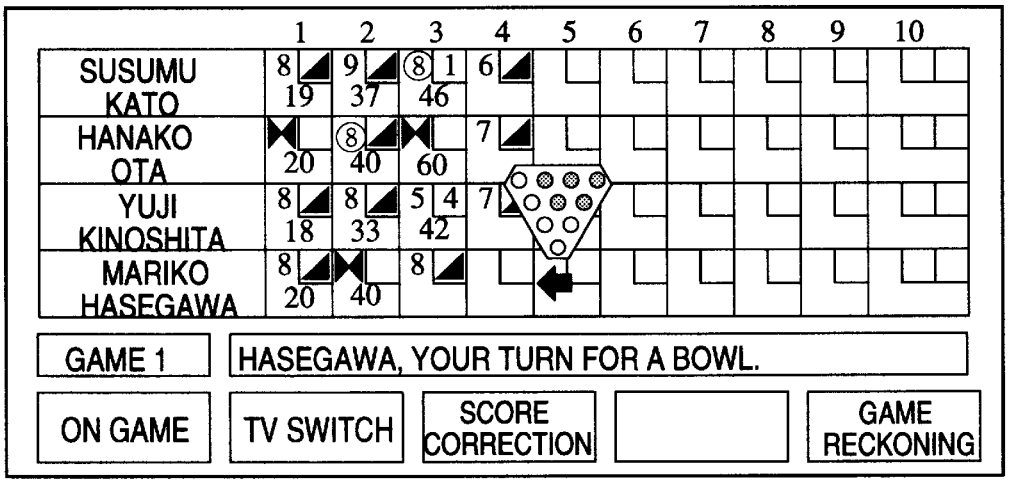
Figure 13:
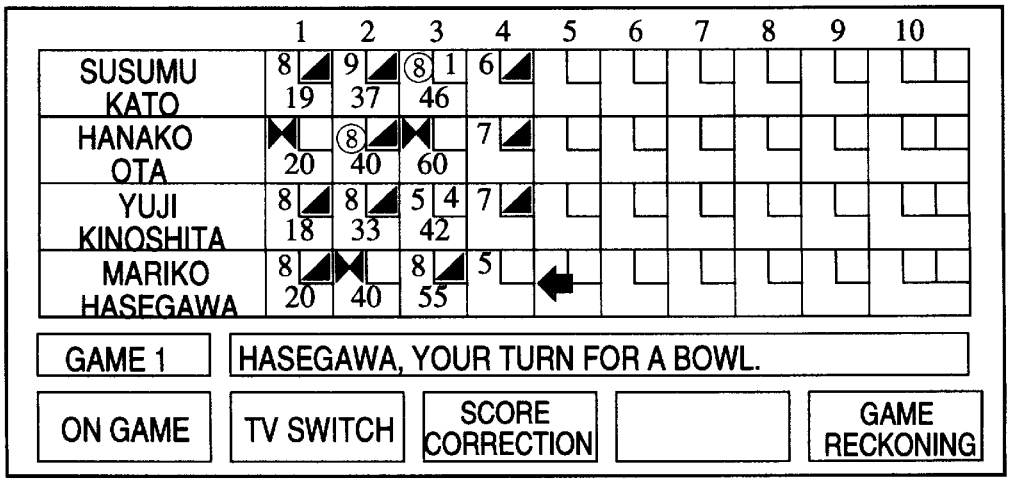

FIG. 13 shows a sixth display example. First, as shown in FIG. 13A, a pattern of fallen pins or remaining pins as a result of a bowl is displayed. Subsequently, the pattern display is scaled down stepwise as shown in FIG. 13B→FIG. 13C, and finally a numeral display is presented in the relevant square.

Figure 14:
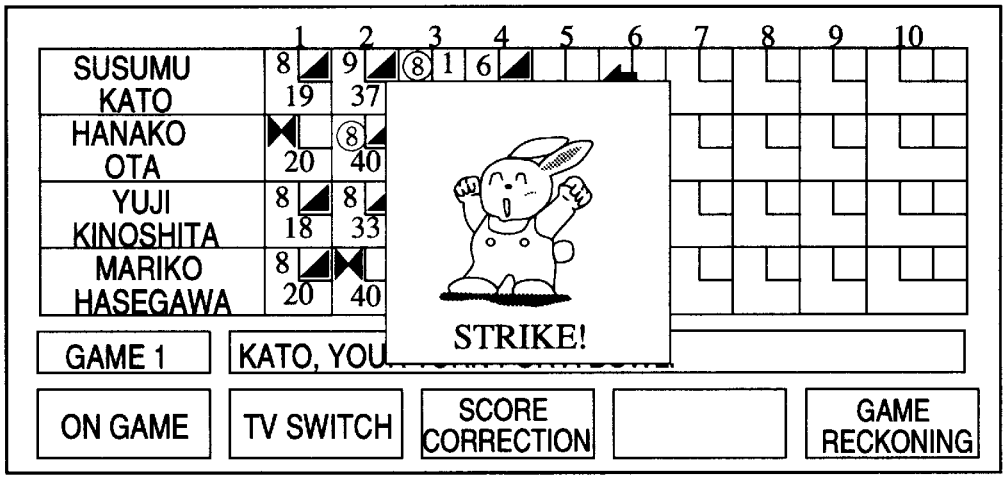
FIGS. 14A, 14B, 14C are views showing a seventh score display example.
Figure 14:
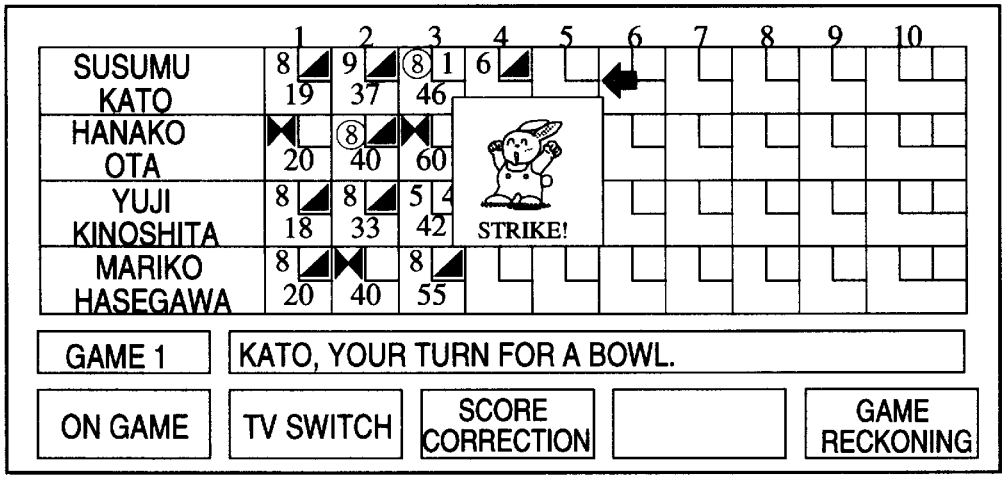
Figure 14:
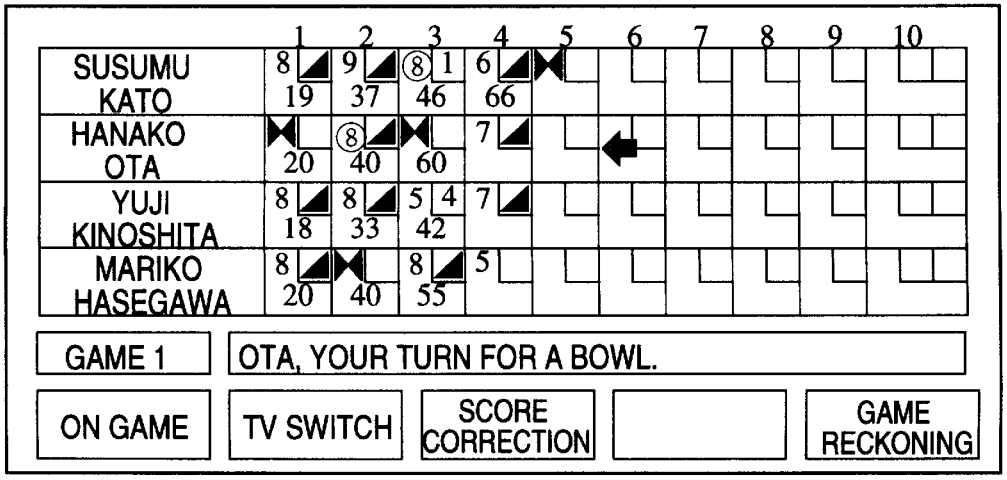

FIG. 14 shows a seventh display example. First, as shown in FIG. 14A, an animation corresponding to the pin state after a bowl is displayed. For example, upon occurrence of a strike, spare, split, gutter or the like, an animation display for applause, encouragement or the like responsive to the event is presented. Subsequently, the animation display is scaled down stepwise as shown in FIG. 14B→FIG. 14C, and finally a numeral display is presented in the relevant square. In this case, although the animation display may be scaled down while the display animation is effected, it is also possible that after a sequence of animation display is ended, the still picture at the end may be scaled down and displayed.

Figure 15:
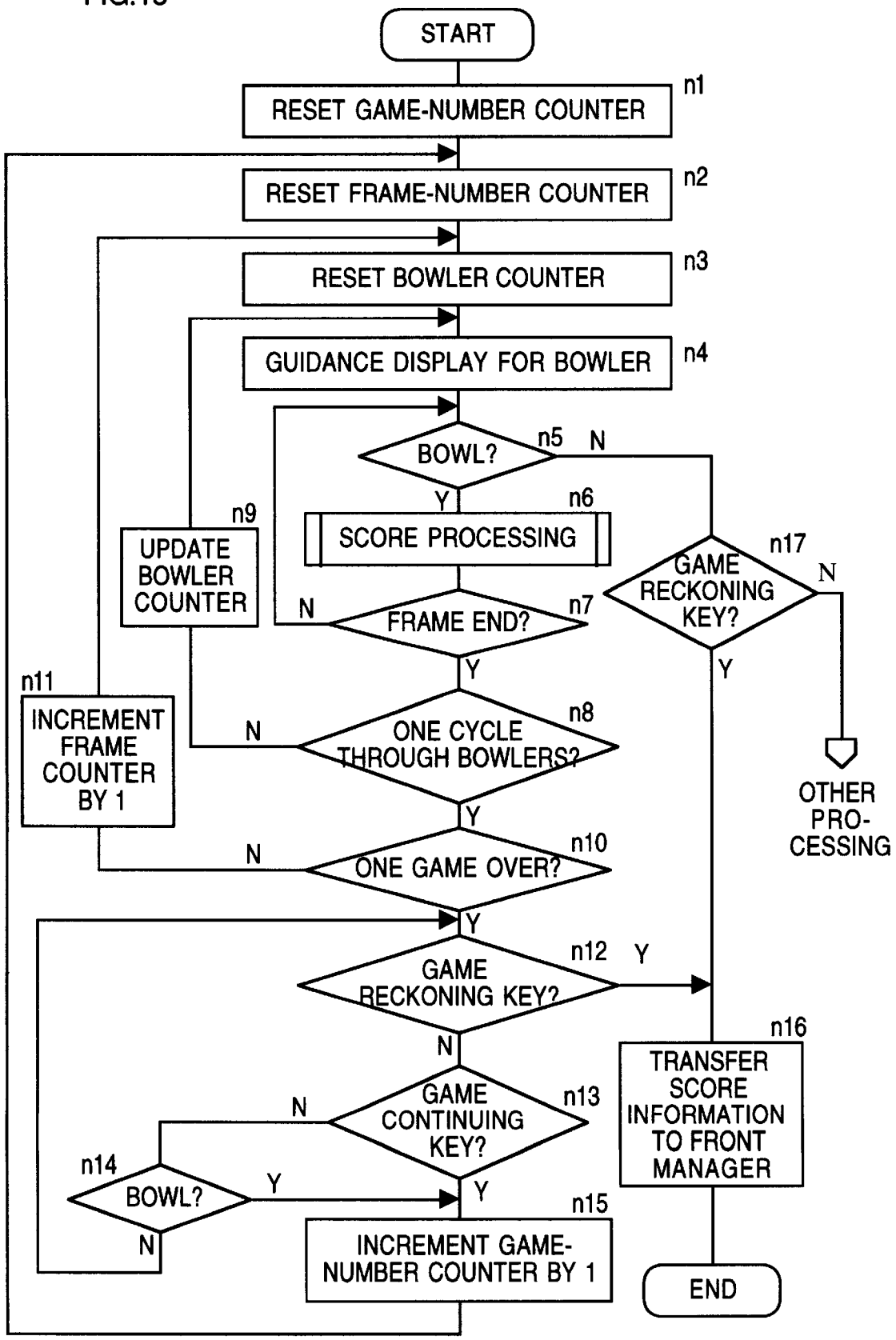
FIG. 15 is a flow chart showing the processing procedure of the whole bowling score display apparatus.
Figure 16:
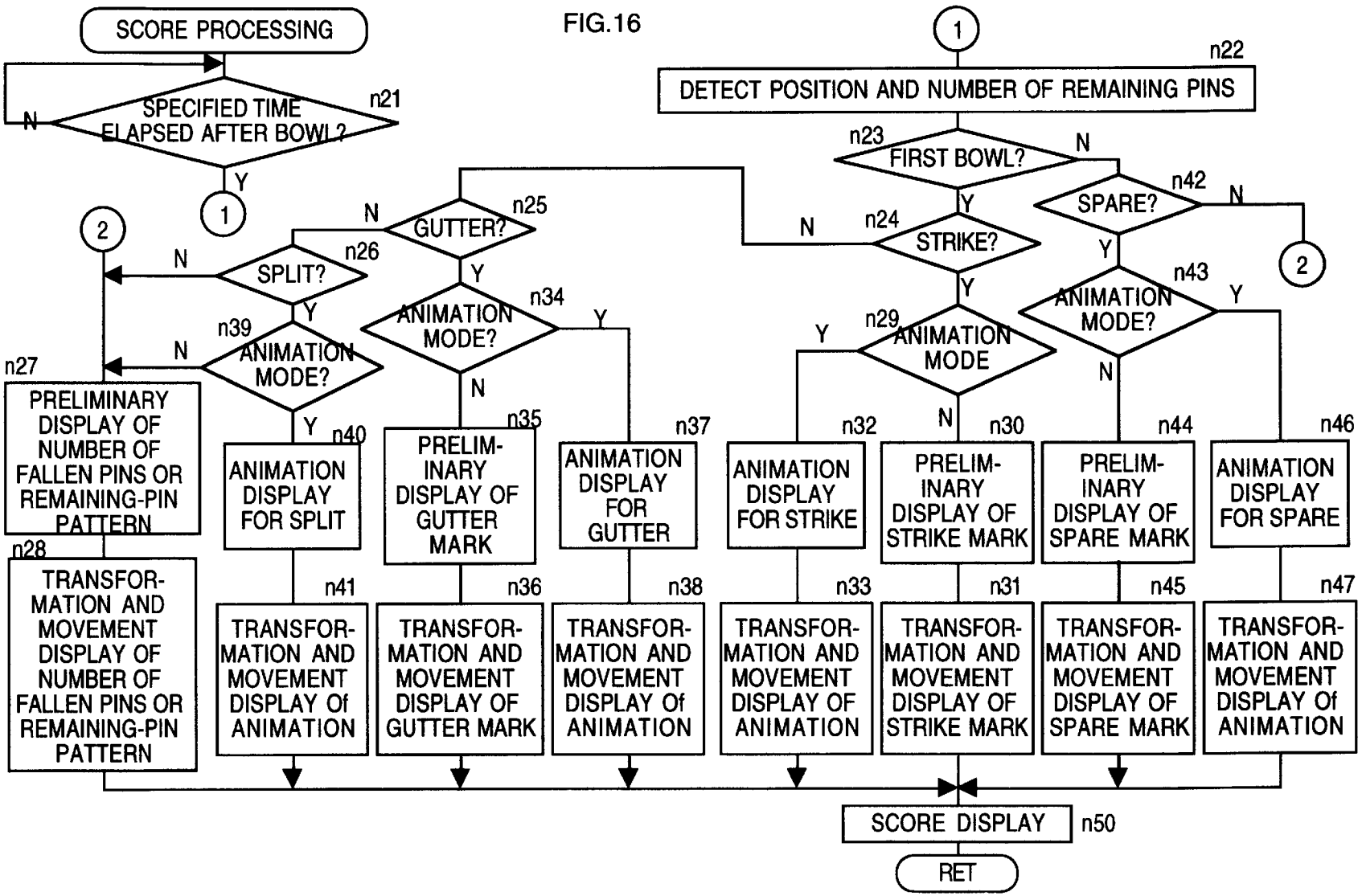
FIG. 16 is a flow chart showing the procedure for score processing.

FIGS. 15 and 16 are flow charts showing the processing procedure of the CPU for executing the above score displays.

FIG. 15 is a flow chart showing a sequence of processing procedure from start to end of a bowling game. First, a game-number counter, a frame-number counter and a bowler counter are reset (n1→n2→n3). It is noted that the "bowler counter" is a counter for counting the ordinal number for turns of bowlers in the case where a plurality of bowlers perform the game at one lane. Subsequently, depending on the value of this bowler counter, the name of a bowler who is now to bowl is displayed, and an arrow mark that specifies a square where a numeric value or mark should be displayed as a result of the bowl, i.e., a square determined by the bowler counter's value and the frame counter is displayed as shown in FIGS. 2 through 14 (n4). When the bowl has been effected, score processing responsive to it is executed (n5→n6). This score processing will be described later based on FIG. 16.

When the frame of the current bowl is completed, the bowler counter is then updated and the processing for the next bowler is executed (n7→n8→n9→n4 . . . ). This processing is repeatedly executed while the frame counter is incremented by one until the tenth frame is completed, i.e., until one game is completed (n8→n10→n11→n3→ . . . ). Now, the program waits for the game reckoning key (the rightmost key out of the four function keys as shown in FIGS. 2 to 14) to be operated, or for the game continuing key (one function key shown at an end of one game) to be operated, or for a bowl of the next game to be performed (n12→n13→n14→n12→ . . . ). If the game continuing key is operated or if a bowl is performed, the game-number counter is incremented by one and similar processing is repeated (n12→n13, n14→n15→n2→ . . . ). If the game reckoning key is operated at the end of one game or during the course of a game, then score information is transferred to the front manager (n17, n12→n16).

FIG. 16 is a flow chart showing the contents of the score processing at step n6 in FIG. 15. First, after a bowl, the program waits for an stabilization of the state of the pins' set position, and then the position and number of remaining pins are detected (n21→n22). For example, when five pins have been fallen down by this bowl, a preliminary display of the number of fallen pins or remaining-pin pattern is presented. A preliminary display of the number of fallen pins as shown in FIGS. 2A, 6A, 9A or the like or a preliminary display of the remaining-pin pattern as shown in FIG. 13A is executed (n23→n24→n25→n26→n27). After that, transformation and movement display of the number of fallen pins or remaining-pin pattern is executed as described in the foregoing various examples (n28). Subsequently, normal score display with the contents updated is executed (n29). If a strike is detected in the normal mode other than the animation mode, then a strike mark is preliminarily displayed and then transformed and moved so that the strike mark is finally displayed in the relevant square (n24→n29→n30→n31→n29). It is noted here that the "animation mode" is a mode in which when a particular event such as a strike or spare has occurred, a previously determined animation display is executed in response to the state of each event. If a strike is detected in the animation mode, then a preliminary display of an animation for strikes as shown in FIG. 14A is executed and subsequently the transformation and movement display of the animation display is executed (n32→n33). If a gutter is detected, then a gutter mark is preliminarily displayed in the normal mode and subsequently transformed and moved (n25→n34→n35→n36). In the animation mode, on the other hand, an animation display for gutters is executed and then transformed and moved (n34→n37→38). Finally, the gutter mark is displayed in the relevant square (n29). If a split is detected at the first bowl in the animation mode, then an animation display for splits is executed and then transformed and moved (n26→n39→n40→n41). If a spare is detected at the second bowl in the normal mode, then a preliminary display of a spare mark is executed and then transformed and moved (n42→n43→n44→n45). If a spare is detected in the animation mode, then an animation display for spares is executed and then transformed and moved (n46→n47).

Figure 17:
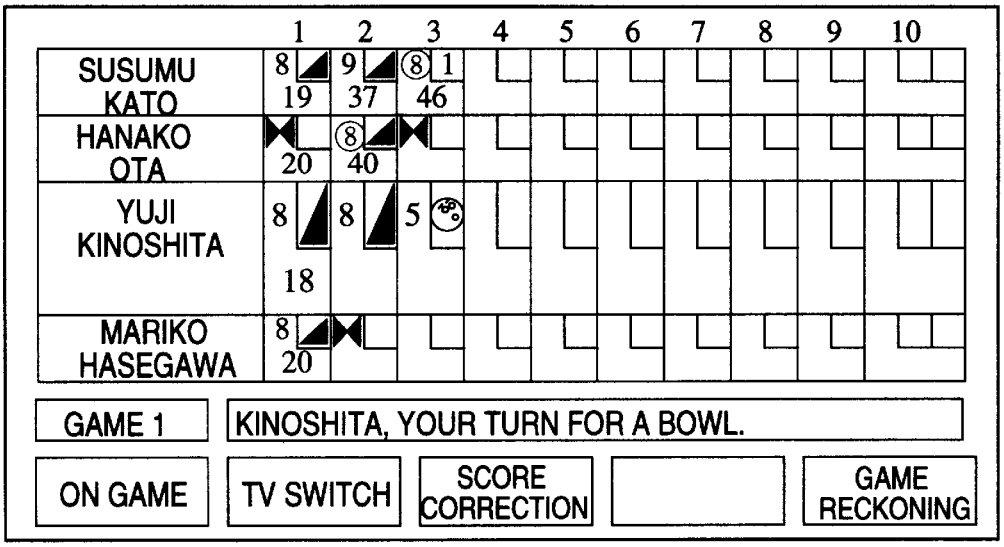
FIGS. 17A, 17B, 17C are views showing a display example in a bowling score display apparatus according to a second embodiment.
Figure 17:
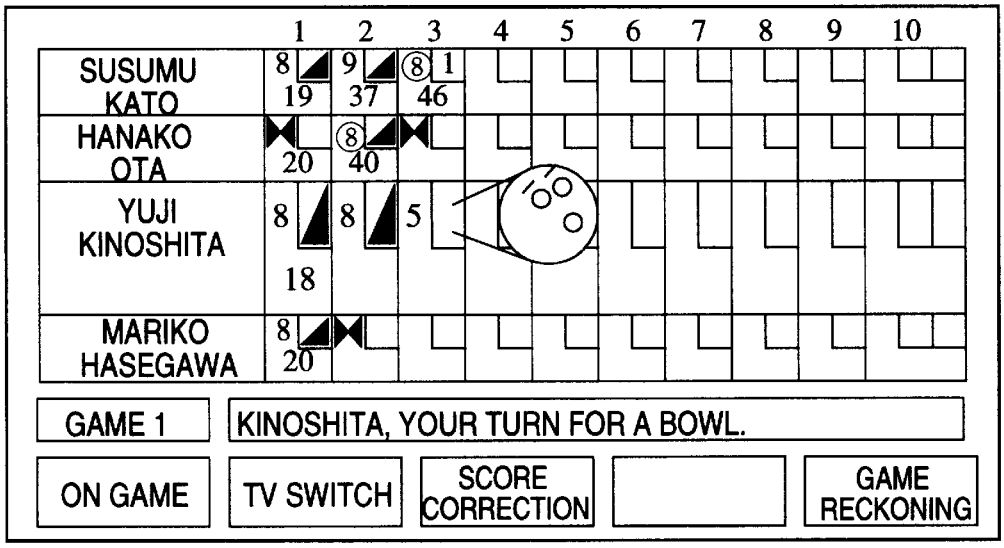
Figure 17:
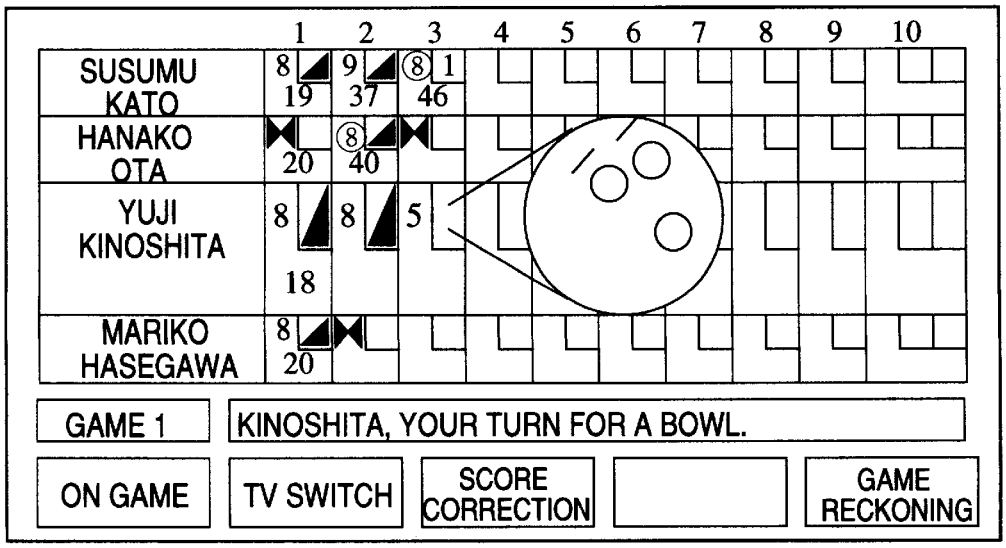
Figure 18:
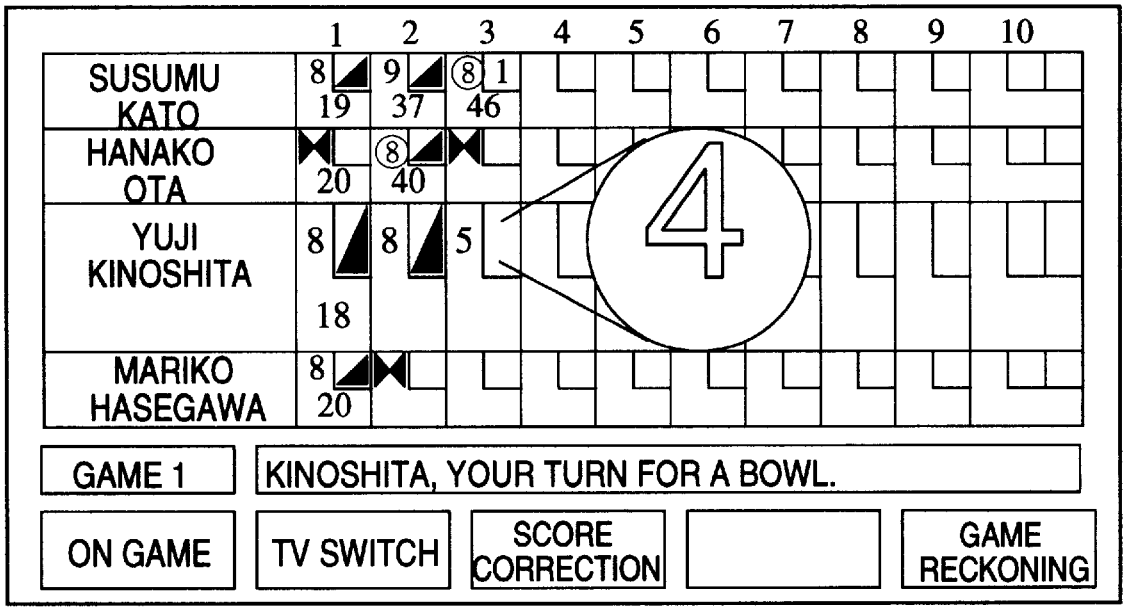
FIGS. 18A, 18B are views showing a display example in the bowling score display apparatus.
Figure 18:
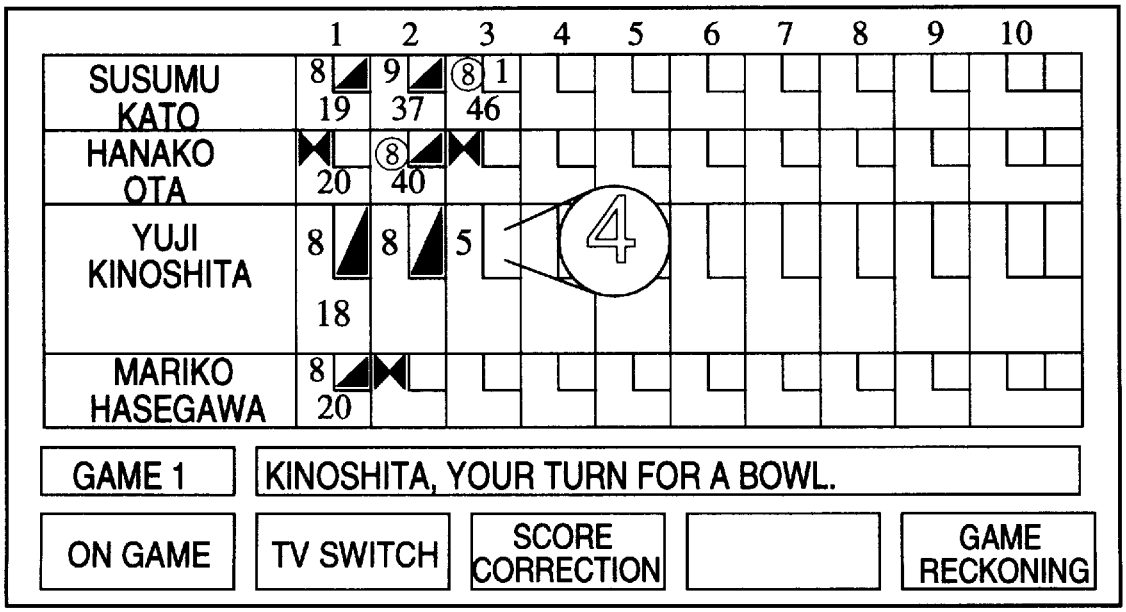
Figure 19:
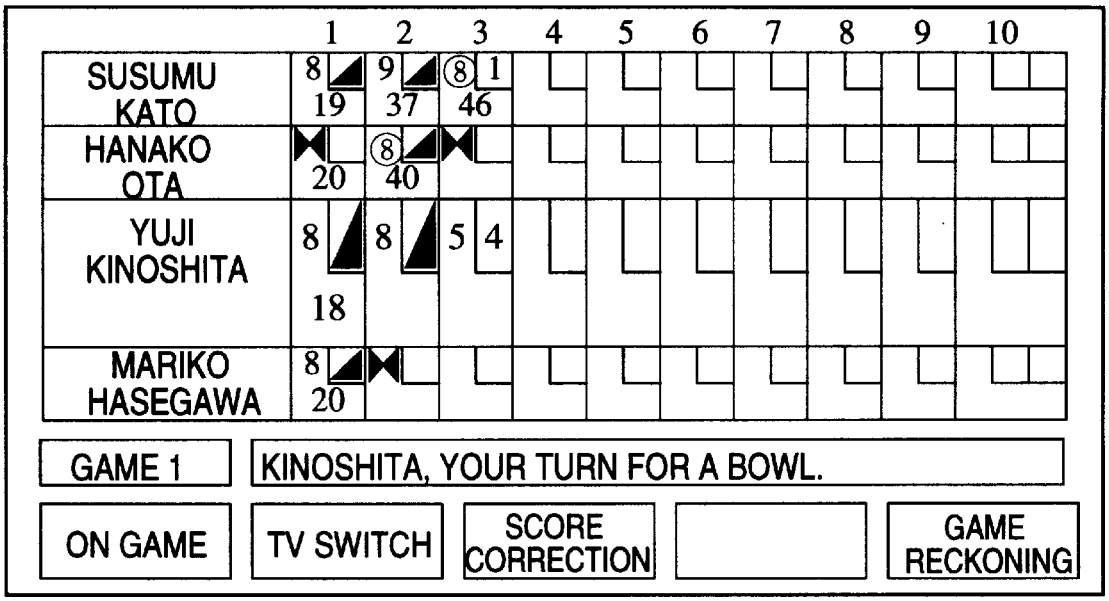
FIGS. 19A, 19B are views showing a display example in the bowling score display apparatus.
Figure 19:
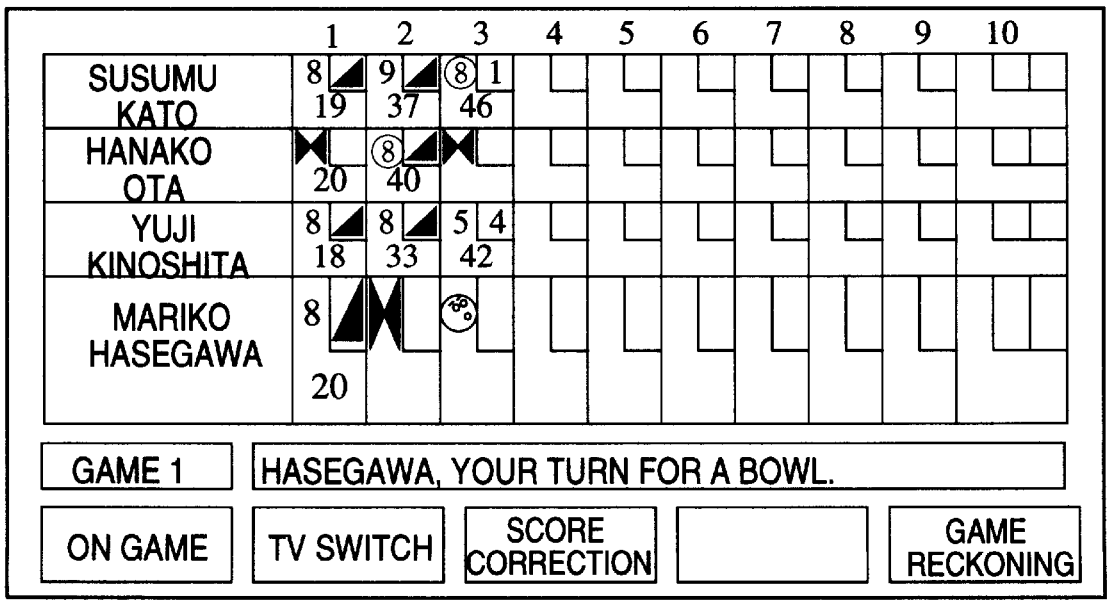

Display examples of a bowling score display apparatus which is another embodiment of the present invention are shown in FIGS. 17 to 19. In this example, the score of a bowler whose display contents should be updated is displayed larger than the scores of the other bowlers. For example, when a bowler (Kinoshita) is to throw the second bowl of the third frame, the score display frame for the bowler (Kinoshita) is displayed up-and-down wider in this example while a bowl-shaped cursor is displayed and blinked at the relevant position as shown in FIG. 17A. After that, when the bowl has been effected, the cursor display is scaled up stepwise and then the number of fallen pins, "4", is displayed at the position of the scaled-up cursor as shown in FIGS. 17B→FIG. 17C→FIG. 18A. Subsequently, the cursor display is scaled down stepwise and the numeric value is displayed in the relevant square as shown in FIG. 18B→FIG. 19A. If a spare results, a spare mark is displayed. Also, if a strike results at the first bowl, a strike mark is displayed.

After that, the score display frame of the bowler (Kinoshita) is displayed in the normal size while the score display frame of another bowler (Hasegawa) is displayed wider as shown in FIG. 19B. Then, the cursor is displayed and blinked at the position of the first bowl of the third frame for the bowler (Hasegawa). After this onward, similarly, the score of the bowler whose display contents should be updated is displayed larger than the scores of the other bowlers, and the cursor is displayed at the relevant position.

Figure 20:
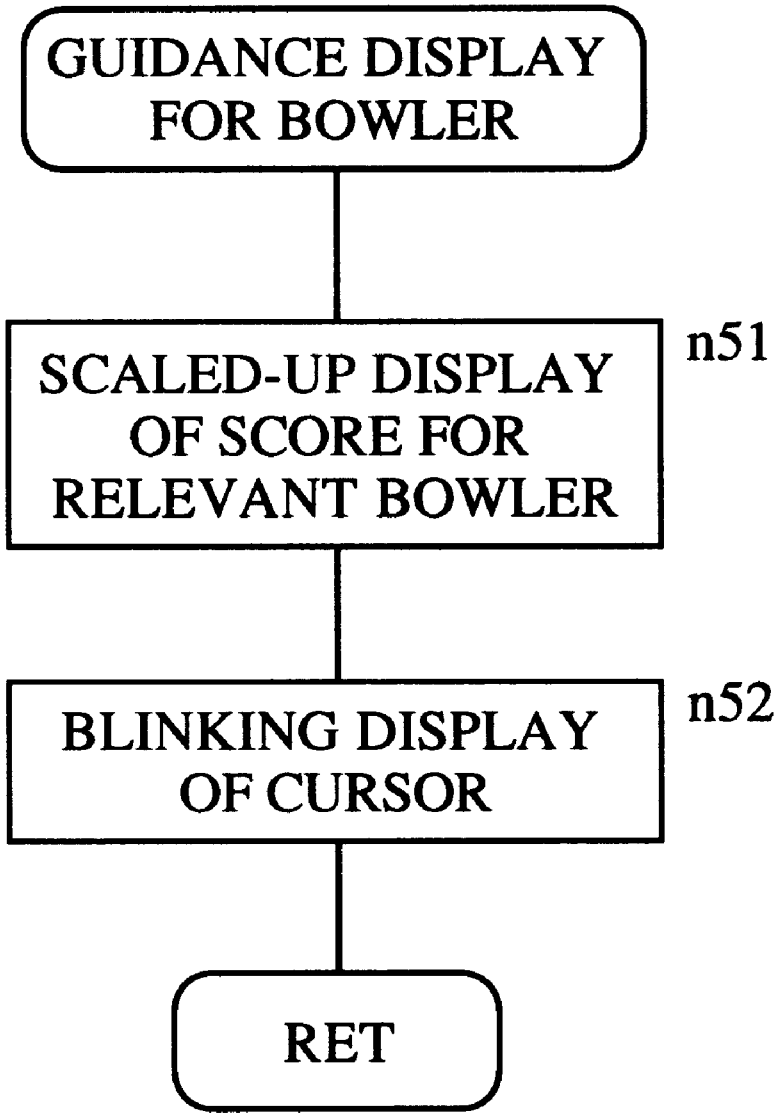
FIG. 20 is a flow chart showing part of the processing procedure of the bowling score display apparatus according to the second embodiment.
Figure 21:
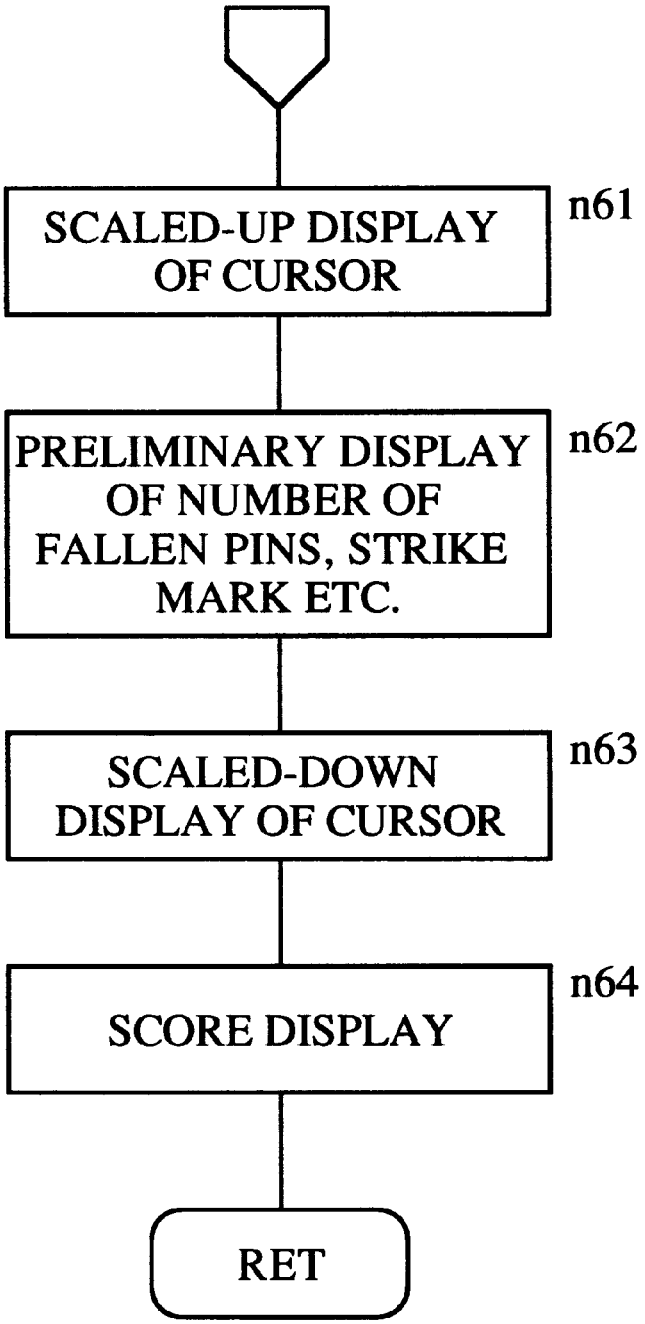
FIG. 21 is a flow chart showing part of the processing procedure of the bowling score display apparatus according to the second embodiment.

The processing procedure for the CPU to execute the above score display is generally similar to that shown in FIGS. 15 and 16. The contents of the bowler guidance display at step n4 in FIG. 15 are given in more detail in FIG. 20. That is, as shown in FIG. 17A and the like, the score display of the relevant bowler is first scaled up and a bowl-shaped cursor is displayed and blinked at the relevant position (n51→n52). Also, contents of the processing subsequent to each of state decisions shown in FIG. 16 are represented comprehensively in FIG. 21. That is, the cursor display is scaled up stepwise, the number of fallen pins or a strike mark or the like is displayed in the cursor, then the cursor display is scaled down, and finally the updated score is displayed (n61→n62→n63→n64).

The above examples have been described on a case where, for displaying the number of pins fallen down by a bowl or a mark for a strike, spare or the like that has occurred as a result of a bowl, a preliminary display is executed and then transformed and moved. However, this may be applied also when a score point is displayed in each frame to be updated by a bowl. For example, when a bowler Kato has fell down one pin at the second bowl in the example of FIG. 2A, the score point in the third frame becomes "46", Where the numeric value may be preliminarily displayed and then transformed and moved as in the above-described case of the display of the number of fallen pins. That is, this embodiment may be applied likewise to the contents to be displayed at each part of the score display.

According to the present invention, the numeric value or mark is not immediately displayed in the relevant square of score display, but it impressionally looks that the numeric value or mark is preliminarily displayed at a place other than the relevant square and then the display contents are transformed or moved and finally accommodated in the square of the score where they should be displayed. Therefore, it becomes possible to easily understand which square of the score display has been changed in display contents by a bowl, i.e., which bowl of which frame by which bowler has been changed in display contents.

Also, the number of pins fallen by a bowl, or that an event such as a strike, spare or gutter has occurred can be understood obviously at a glance.

Also, it can be easily understood that contents of preliminary display have entered into a specified square of score display.

Furthermore, it can be easily understood who is the bowler that is next to bowl or the bowler that has performed a bowl, or which frame the next bowl falls upon.

What is claimed:

1. A bowling score display apparatus comprising:

a pin detection device for detecting a state of at least one pin in a pin set position after a bowl;

a counter for counting a bowling score from the state of the at least one pin after the bowl; and a score display for displaying the bowling score, said score display preliminarily displaying a graphic image responsive to the state of the at least one pin after the bowl, wherein said score display is comprised of squares corresponding to a bowling frame for each player bowling, and said score display, after preliminarily displaying said graphic image, transforming the graphic image into a displayed element of a displayed bowling score, wherein said graphic image deforms and moves successively towards one of the squares of said score display corresponding to a current bowling frame while transforming the graphic image into the displayed element of the displayed bowling score.

2. The bowling score display apparatus according to claim 1, wherein the graphic image is an image of a numeric value corresponding to a number of the at least one pin that fall as a result of the bowl, and the displayed element of the displayed bowling score is an image of a numeric value corresponding to the number of fallen pins that is smaller in size than the first graphic image.

3. The bowling score display apparatus according to claim 1, wherein the graphic image is a mark which indicates the occurrence of a game event and which is larger than the displayed element of the displayed bowling score.

4. The bowling score display apparatus according to claim 1, wherein the score display displays tracks of display during the process of transforming the graphic image.

5. A bowling score display apparatus comprising:

a pin detection device for detecting a state of at least one pin in a pin set position after a bowl;

a counter for counting a bowling score from the state of the at least one pin after the bowl;

a score display for displaying the bowling score, said score display preliminarily displaying a graphic image responsive to the state of the at least one pin after the bowl, wherein said score display is comprised of squares corresponding to each bowling frame for each player bowling, and said score display, after preliminarily displaying said graphic image, transforming the graphic image into a displayed element of a displayed bowling score, wherein said graphic image deforms and moves successively towards one of the squares of said score display corresponding to a current bowling frame while transforming the graphic image into the displayed element of the displayed bowling score, and said score display displays the bowling score of a current bowler in a size larger than bowling scores of other bowlers.

* * * * *